US009610678B2

(12) United States Patent
Shields

(10) Patent No.: US 9,610,678 B2
(45) Date of Patent: Apr. 4, 2017

(54) MODULAR TELESCOPING POWER POLE AND BAR CLAMP/SPREADER TOOL

(71) Applicant: Rodney M Shields, Ukiah, CA (US)

(72) Inventor: Rodney M Shields, Ukiah, CA (US)

(73) Assignee: Mindflow LLC, San Francisco, CA (US)

( * ) Notice: Subject to any disclaimer, the term of this patent is extended or adjusted under 35 U.S.C. 154(b) by 0 days.

(21) Appl. No.: 14/212,623

(22) Filed: Mar. 14, 2014

(65) Prior Publication Data

US 2014/0259534 A1 Sep. 18, 2014

Related U.S. Application Data

(60) Provisional application No. 61/790,504, filed on Mar. 15, 2013, provisional application No. 61/790,565, filed on Mar. 15, 2013.

(51) Int. Cl.
*B25G 1/10* (2006.01)
*A45C 13/26* (2006.01)
*B25G 1/04* (2006.01)

(52) U.S. Cl.
CPC ..... *B25G 1/04* (2013.01); *Y10T 16/473* (2015.01)

(58) Field of Classification Search
CPC ... Y10T 16/473; Y10T 16/498; Y10T 16/469; B25G 1/02; B25G 1/04; B25G 1/025; B25G 1/06; B25G 1/043; B25G 1/046; B25G 3/00; B25G 3/02; B25G 3/04; B25G 3/24; B25G 3/26; B25G 3/08
USPC ... 16/422, 427, 436; 15/144.4, 147.2, 143.1; 403/109.3, 109.7; 81/177.1, 177.2, 489, 81/491; 248/200, 200.1, 241, 244, 245; 211/105.3, 105.4; 269/143, 145, 269/146–149, 152, 249, 194, 193
See application file for complete search history.

(56) References Cited

U.S. PATENT DOCUMENTS

| | | | | | |
|---|---|---|---|---|---|
| 1,583,611 | A | * | 5/1926 | Seely | 269/146 |
| 2,779,561 | A | * | 1/1957 | Blundeau | 248/238 |
| 3,076,263 | A | * | 2/1963 | Musto | 30/317 |
| 3,220,691 | A | * | 11/1965 | Dudley | 249/18 |
| 3,336,617 | A | * | 8/1967 | Bosko et al. | 15/146 |
| 4,062,156 | A | * | 12/1977 | Roth | 52/111 |
| 4,498,662 | A | * | 2/1985 | Halter | 269/101 |
| 4,505,040 | A | * | 3/1985 | Everts | A01D 34/416 172/41 |
| 4,733,471 | A | * | 3/1988 | Rahe | 30/276 |

(Continued)

*Primary Examiner* — Chuck Mah
(74) *Attorney, Agent, or Firm* — Anthony J. Patek

(57) ABSTRACT

The invention is a set of modular telescoping tools. A first preferred embodiment is a power-transmitting telescoping extension pole, to which various specialized tools, including power tools, may be attached. The apparatus comprises an inner tube and outer tube, wherein the outer tube receives said inner tube, a coupling at the tool-end of the pole, a power transmission, capable of transmitting power from the user-end of the pole to the tool-end of the pole, and a control mechanism attached to the telescopic tube at the user-end of the telescopic tube. A second preferred embodiment is a set of telescoping bar clamps and spreader tools. In the simplest embodiment, the invention comprises a telescoping tube and a set of jaws, wherein the telescoping tube includes a first shaft having a first diameter, a second shaft having a second diameter that is less than the first diameter, and a locking mechanism.

17 Claims, 30 Drawing Sheets

(56) References Cited

U.S. PATENT DOCUMENTS

| | | | | | |
|---|---|---|---|---|---|
| 4,793,197 | A * | 12/1988 | Petrovsky | 74/89.35 | |
| 4,793,646 | A * | 12/1988 | Michaud, Jr. | 294/210 | |
| 4,819,293 | A * | 4/1989 | Nicholson | 15/172 | |
| 4,924,573 | A * | 5/1990 | Huddleston et al. | 30/272.1 | |
| 5,161,318 | A * | 11/1992 | Bergman | E01H 5/04 | 37/233 |
| 5,328,364 | A * | 7/1994 | Doyle | 433/18 | |
| 5,381,578 | A * | 1/1995 | Armbruster | A47L 11/284 | 15/145 |
| 5,511,269 | A * | 4/1996 | Watson | 15/22.1 | |
| 5,594,990 | A * | 1/1997 | Brant | B25F 5/02 | 172/14 |
| 5,603,173 | A * | 2/1997 | Brazell | 37/244 | |
| 5,617,698 | A * | 4/1997 | Guilmette | 52/749.1 | |
| 5,662,428 | A * | 9/1997 | Wilson | A01D 34/902 | 172/13 |
| 5,729,865 | A * | 3/1998 | Stoddart | 16/429 | |
| 5,881,601 | A * | 3/1999 | Hammer | 74/422 | |
| 6,182,539 | B1 * | 2/2001 | Webster | 81/177.2 | |
| 6,461,074 | B2 * | 10/2002 | Taylor | 403/378 | |
| 6,530,565 | B1 * | 3/2003 | Simpson | 269/6 | |
| 6,643,958 | B1 * | 11/2003 | Krejci | 37/223 | |
| 6,971,641 | B1 * | 12/2005 | Sherwin | 269/166 | |
| 7,114,715 | B1 * | 10/2006 | Kirk | 269/147 | |
| 7,314,096 | B2 * | 1/2008 | Shaffer et al. | 172/372 | |
| 7,398,966 | B2 * | 7/2008 | Hubbard | 269/88 | |
| 7,721,377 | B2 * | 5/2010 | Jungklaus et al. | 15/144.4 | |
| 8,024,995 | B2 * | 9/2011 | Dayton et al. | 81/52 | |
| 8,882,166 | B2 * | 11/2014 | Ramsey et al. | 294/210 | |
| 2004/0182806 | A1 * | 9/2004 | Figueroa | 211/105.4 | |

* cited by examiner

MODULAR TELESCOPING POWER POLE AND BAR CLAMP/SPREADER TOOL

This invention relates to telescoping extension poles integrated with various tools. This application claims benefit under 35 U.S.C. §120 of the filing dates for applications Nos. 61/790,504 and. 61/790,565, both filed Mar. 15, 2013.

BACKGROUND OF INVENTION

Maintenance and repair tasks such as painting, sanding, gutter cleaning, and fixture replacement require the use of specialized tools in hard to reach areas. In many such cases, the user must operate specialized equipment while using a ladder, which can greatly increase the duration and inconvenience of completing the task at hand, as well as being potentially unsafe. If a particular task requires several specialized tools, it is likely that the operator will need to dismount the ladder each time he or she desires to switch tools. Additionally, the ladder must be repositioned often as it provides only a small reachable work space. Many times the ladder simply cannot be placed in an appropriate area to complete a task due to uneven ground or obstacles, which make completing the task near impossible. In other cases, homeowners or service providers must work in areas low to the ground, requiring extensive bending or kneeling, both of which can become physically taxing.

One solution to this problem is the use of extension poles. Fixed length extension poles are common, and are often used for tasks such as painting. In addition, telescoping extension poles are well known in the art, as in U.S. Pat. Nos. 5,729,865 and 6,546,596. In a typical telescoping extension pole, an outer tube holds an inner tube which can be extended to a desired length and locked into place. Such devices are useful, for example, as tool extenders to extend the reach of a user for the application of a tool such as a paint roller. These prior art extension poles are not suitable for use with power tools because they do not include power transmission means.

Also known in the art are bar clamps and spreader tools. Spreaders and bar clamps typically consist of two jaws attached to a fixed-length bar. Each jaw has at least one surface that defines a plane that is fixed in parallel to at least one surface of the other jaw, with one jaw attached to one end of the spreader tool or bar clamp in a fixed fashion, and the other jaw attached in an adjustable manner. For bar clamps, the parallel surfaces must face each other, and the adjustable jaw is adjusted to apply compression pressure on one or more objects within the clamp like a vise. For spreader tools, surfaces facing away from each other are required, and the adjustable jaw is adjusted to apply outward pressure, thereby spreading two surfaces or objects apart. Combined bar clamp/spreader tools (e.g., Jet 70412 parallel clamp, Irwin Quick-Grip bar clamp/spreader) are known, in which reversible jaws allow conversion from a bar clamp to a spreader tool, and vice versa.

Many configurations of these devices exist. For example, very simple bar clamps use a single screw axle to attach the jaws in a vise-like fashion. Other bar clamps utilize two or three bars to attach and stabilize the jaws; a screw axle fits snugly with the interior of the adjustable jaw allows force to be applied to move the adjustable jaw, while the additional bars have smooth surfaces and act only to stabilize against rotation and torsion of the jaws. Yet other bar clamps (e.g. Irwin Quick-Grip 5412, Jorgensen 33412 One-Handed bar Clamp, Dewalt DWHT83139 Bar Clamp) utilize a squared bar of fixed length, and use ratcheting grips to move and tighten the adjustable jaw. Other version use bars with notches or holes, and use pins or similar mechanisms to lock the adjustable jaw in place relative to the bar (e.g., Jorgensen style 3700 light-duty bar clamp, Irwin light-duty bar clamp). These lighter-duty versions will often utilize a C-clamp type of structure, with the actual contact surface of the jaw attached to a secondary screw axle to allow fine adjustment of the jaw position.

These prior art bar clamps and spreader tools have limitations. For example, most reversible bar clamps/spreader tools require that you take off the adjustable jaw and flip it around to change the function of the device from spreader to clamp and back again. This can be tiresome and can be made more efficient. Known bar clamps can only apply pressure along one direction and in one orientation. And all of these bar clamps/spreader tools are limited in range according to the length of the bar they utilize. Longer spreader vices are long, unwieldy, and difficult to store. At the same time, the shorter spreader vices can be too short to accomplish the desired task. This requires users to purchase a collection of bar clamps/spreader tools in a variety of lengths.

BRIEF SUMMARY OF THE INVENTION

The invention is a set of modular telescoping tools. A first preferred embodiment is a power-transmitting telescoping extension pole, to which various specialized tools, including power tools, may be attached. A second preferred embodiment is a set of telescoping bar clamps and spreader tools.

A power-transmitting extension pole allows users to operate specialized tools, such as power tools, via a power-transmitting extension pole. The user need not place or climb ladders or bend down to operate equipment in hard to reach areas; rather, the user attaches the desired tool to the power-transmitting pole and simply uses the extension capabilities of the pole to position and operate the tool in such areas. This eliminates the need for ladders to complete jobs high above the head, as the tool can simply be raised above the head with the extension pole. It eliminates the need to bend or contort to reach low areas, as the pole can simply be pointed down to the area. The invention could include features which allow for the positioning and adjustment of tool position while secured on the pole. In addition, the extension power pole can take on a number of configurations which make it possible to efficiently switch tools during the completion of a task. Power is transmitted from the proximal handle of the pole, held by the user, to the distal end of the pole, which secures the tool itself. A number of potential drive mechanisms and configurations make it possible to incorporate a wide range of tools on the extension power pole, including battery, cord, and air-operated power tools, specialized instruments like brushes and concrete trowels and others. The extension power pole could be used in an infinite number of home, lawn, and work-related tasks such as painting, sanding, scraping, cleaning, concrete finishing, and landscaping.

With respect to the extension pole embodiment, the apparatus comprises an inner tube and outer tube, wherein the outer tube receives said inner tube. On one end of the pole, preferably the out tube, is a user handle, which may have additional power or control features depending on the specific embodiment of the extension pole. The distal end of the pole is outfitted to hold and secure the tool to be used. The tool is secured through a coupling at the tool-end of the pole. The tool may be specialized with a dedicated coupling to the pole, or may be a general purpose version of the tool (i.e., one normally used in a hand-held manner without attachment to the extension pole), in which case the tool-end coupling will be specialized to hold and convey power to the tool. The pole itself can be different lengths, depending on the intended use and how far away the user would like to operate the tool, but will typically be between one and three meters in length. The extension pole has a power transmission, such as an electrical conduit or mechanical transmission, that is capable of transmitting power from the user-end of the pole to the tool-end of the pole. In embodiments where the coupling at the tool-end of the pole is specialized to couple to a general purpose version of the tool, this allows the tool to receive power and operate without direct connection to its usual power source. The coupling at the tool-end of the pole could take on a number of different configurations to accommodate a number of different tools and uses, such as those from different manufacturers and with different functions. A wide variety of tools could be adapted to use with the invention, such as heavy duty wire brushes or power drills. Due to the range of potential uses of the device, the potential configurations are extensive.

In some configurations, the extension power pole could have a battery pack at the user-end of the pole to supply power to tools at the tool-end. The power from the battery pack could be relayed to the tool via internal or external power cords, in cases where an external power cord would not impede the function of the device. Additionally, the power could be relayed via a sliding mechanism or other mechanical transmission housed inside or outside the hollow tube of the extension pole. If desired, solar cells could be outfitted to the exterior of the extension pole to aid in recharging the battery pack. The weight of the battery pack at the user-end of the extension pole would help counterbalance the weight of the tool at the opposing end, increasing the ease of use of the pole.

In other configurations, the extension power pole could derive electrical power from a cord plugged into a power outlet. In such configurations, the pole could have additional features such as a power outlet, for other power tools to plug into, or a cord reel to take up and house the power cord when the pole is done being used.

In these configurations, it is possible to incorporate additional features, such as adapters at the tool-end of the device to fit a number of different tools to the extension pole. A swivel and locking feature could be added to the tool-end of the device to allow the user to decide the appropriate position of the tool and then lock it into that position. Such a mechanism could be set manually prior to use at the tool-end, or could be adjusted at the handle during use. Additional adjustment settings could be implemented in the pole such as variable speed or direction reversal triggers.

In still other configurations, the extension pole could be manually powered by transmitting a rotational force via assemblies enclosed inside the hollow tube or outside the tube. Such manual power could be supplied at the user end by mechanisms such as squeeze grips, a rotating handle, or slide mechanisms. Such configurations would be ideal for situations such as pruning and grabbing. Rotational power transmission mechanisms could also be used to implement an articulation feature on any number of configurations.

Because the extension pole is hollow, it is also possible to use fluid flow in many configurations. Fluid could be conveyed inside the pole tube itself, with power transmission assemblies operating outside the tube. Possible uses of fluid include cleaning and spraying fluids, hydraulic fluid to activate hydraulic features in a tool on the tool-end of the pole, or vacuuming functions. Compressed air could also be conveyed through the extension pole to operate air-powered tools.

These configurations and features can be combined almost endlessly. One possibility is for an extension pole transmission shaft assembly, which allows for multiple different adapters or tools to be outfitted to the tool-end and multiple different drive mechanisms, such as battery packs or manual power transmission subassemblies, to be outfitted to the user-end of the device. Additional possibilities exist to combine multiple power mechanisms to add additional functionality to a tool. One such example is a vacuuming device, powered via air flow through the main hollow tube of the extension pole, with an additional external power transmission assembly (such as a rotational transmission assembly) that provides articulation, so the vacuum can be utilized in many difficult to reach spaces.

A related variation of the invention is a modified bar clamp/spreader tool utilizing a telescoping tube assembly. In the simplest embodiment, the invention comprises a telescoping tube and a set of jaws, wherein the telescoping tube includes a first shaft having a first diameter, a second shaft having a second diameter that is less than the first diameter, and a locking mechanism. The first shaft and second shaft are fitted together and arranged along a common axis such that at least a portion of the second shaft lies within the first shaft, with said first shaft and second shaft being movable in relation to one another along the length of the common axis. The set of jaws is comprised of a first jaw and second jaw, wherein the first jaw is attached to the first tube of the telescoping pole, and the second jaw is attached to the second tube of the telescoping pole. The telescoping pole may be extended or collapsed as needed to vary the width of the clamp/spreader. A locking mechanism holds the two shafts in a fixed position.

DETAILED DESCRIPTION OF INVENTION

Extension Power Pole

In general, the device comprises an extendable pole, a user-end interface, and a tool-end interface, and a transmission embedded within the extendable pole, said transmission coupled to both the user-end interface and the tool-end interface.

The user-end can be attached to a type of power source, such as a battery pack or power outlet, or can have features such as squeeze grips or rotational capabilities to provide manual power. Additionally, the user-end interface may be equipped with additional features such as triggers to control position of the tool-end of the device and the speed or directionality of the tool at the tool-end of the device. The user-end can be fixed to one type of power source permanently, such as a built-in battery, or can have multiple power sources, such as a battery pack and manually powered squeeze grips, or can be modular to allow for different combinations of power sources, including removable battery packs.

The tool-end of the device can couple to an instrument or tool. In some embodiments, the device can permanently hold one type of tool. In other embodiments, the coupling can be modular to allow for different tools to be coupled to the extension pole. The tool-end may be equipped with other features, such as a pivoting function to allow for different orientations of the tool. These features could be permanent or modular.

The two interface ends of the device are connected by an extendable pole, in some configurations a hollow tube. The extendable pole comprises a plurality of telescoping tubes or shafts. After the extendable pole is extended to a desired length, the telescoping sections of the pole can be locked into place by locking devices affixed to the pole. In addition, the tube could be equipped with additional features such as solar power cells to aid in recharging batteries or powering the drive functions. The tube can, in some cases, house internal components which may transmit power from the user-end to the tool-end.

Extension Pole

Figure 7:
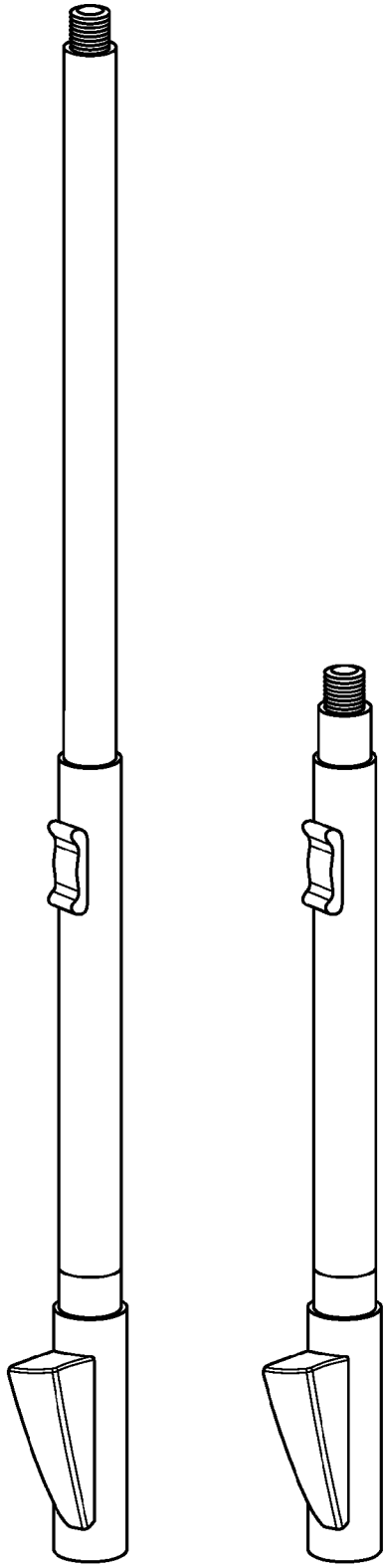
FIG. 7. Depiction of extension pole in extended and retracted positions.

The extendable pole is comprised of at least two sections, including an outer pipe or tube that receives an inner pipe or tube. In most embodiments, the inner pipe will be the distal, "tool-end" section of the pole 503, and the outer pipe will be the proximal, user-end of the pole 504. This distal end slides freely within the larger proximal section of the pole 504 but can be locked into place via an extension lock 505 on the side of the extension pole, as shown in FIG. 7, which displays the extension pole in extended and collapsed positions. In most embodiments, the extension pole will be hollow to allow for power transmission through the interior of the pole, or to allow fluid, particle, air or gas flow through the pole, in the case of spraying or vacuum-type embodiments.

The extension pole components could be made of a number of different materials including fiberglass, aluminum, steel, carbon fiber, resins, plastics, or other lightweight, strong materials. The pole may be made of a single material, or composed of a plurality of materials to optimize weight and strength. For example, the majority of a pole section may be made of one material, with reinforcing elements distributed as rods or strands extending through the primary material. The pole surfaces may be smooth, grooved, or articulated, depending on design choices made for a particular embodiment. The tubes of the pole may also be rotationally fixed in relation to one another, or may be free to rotate in relation to one another.

Figure 8:
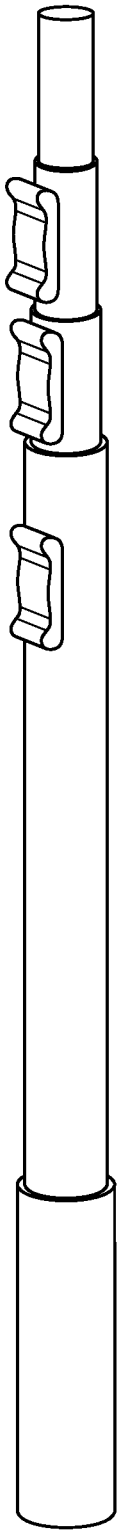
FIG. 8. Extension pole with four telescoping sections.

A person of skill in the art will recognize that other variations on this basic structure are possible. For example, the tube could be comprised of several sections for additional functionality, as illustrated in FIG. 8.

Locking Mechanism

Each embodiment of the invention utilizes a locking mechanism of some kind to hold the extension pole tube sections in place. In most embodiments, the locking mechanism will be an extension lock 505. A person of skill in the art will recognize that a wide variety of extension locks 505 are suitable for use with the current invention. Many different extension pole locking devices exist in the prior art and may be employed with the different configurations of the current invention. Examples of such locking mechanisms include various detent locking devices, threaded collets, poles manufactured with deformations or eccentric locking surfaces, spring-loaded toggle clips, positioning holes with spring-loaded buttons, and locking pins, including threaded pins or screws and concentric overcenter actuation pins, collar locks, and slider catches.

Power Supply and Transmission

The power for operating tools at the tool-end of the device can be supplied in a number of ways. In some configurations of the device (e.g., FIG. 9), a battery pack 191 may be affixed to the user-end of the extension pole 001. The battery pack may be removable, or the power supply may be permanently fixed to the extension pole 001, as in the case of an affixed drive motor 401 shown in FIG. 4. In other configurations, the extension pole can include an electrical power cord which plugs into a power outlet. In such cases, the extension power pole may also include features such as additional electrical power outlets on the device or a take up reel or housing for an electrical transmission wire or cord to be stored on the device. In embodiments of the invention where electrical power is being transmitted, power could be relayed from the user-end to the tool-end via an internal or external power cord that can extend and recoil when the extension tube elongates and retracts.

In mechanical transmission configurations, the extension pole can be powered mechanically through features on the user-end of the device. Such features could include a rotating handle piece 501, squeeze grips 601 cranks, hand wheels, slide handles and the like. There are many potential mechanisms by which power from a power supply can be relayed mechanically from user-end to tool-end.

Figure 1:
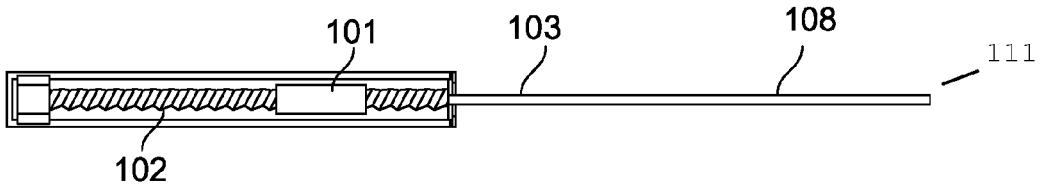
FIG. 1. Cross-section of a manual power transmission assembly housed within extension pole.
Figure 2:
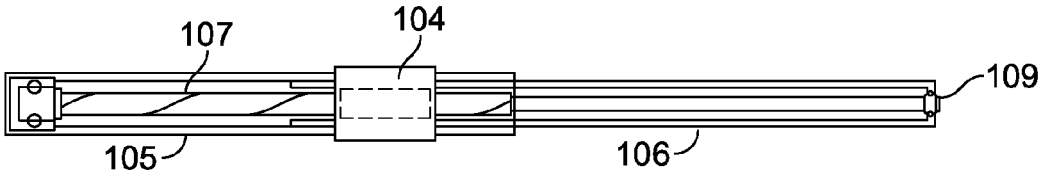
FIG. 2. Cross-section of manual power transmission assembly with external grip.
Figure 3:
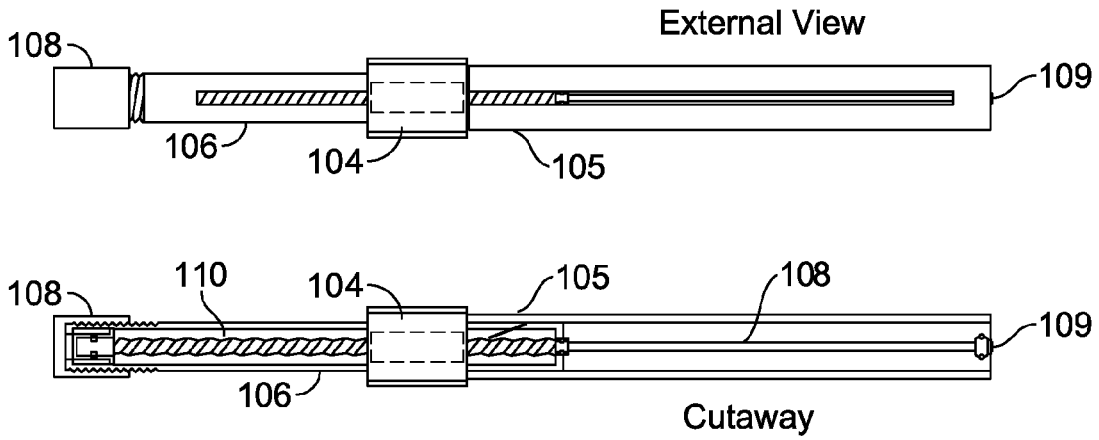
FIG. 3. Cross-section of adjustable manual power transmission assembly.

One possibility is internal or external sliding mechanisms to mechanically transfer manual inputs at the user-end of the pole into rotational energy at the tool-end of the pole. Three embodiments of such a mechanical transmission mechanism can be seen in FIGS. 1-3. In FIG. 1, an internal slider 101 exerts force within an internal track 102 of a shaft. The linear motion of the slider provides rotational energy which propagates through an extendable drive mechanism 103, which engages and powers a tool (not depicted) at the tool-end 111 of the device. In a second embodiment, shown in FIG. 2, a linear slider 104, which is attached to an internal slider 101 (shown in FIG. 1), surrounds the inner 106 and outer 105 telescoping components of the extendable pole and engages with a threaded shaft 107. Manually input linear motion of the slider 104 translates to rotational energy as the slider turns the threaded shaft 107 to power the extendable drive mechanism at the tool-end of the pole 111. In FIG. 2, the extendable drive mechanism can interface with an additional collar or coupling 109 at the tool end by fitting inside the coupling and rotating the coupling in sync with the drive mechanism. The coupling 109 could in turn transmit rotational power to the attached tool. In an additional embodiment shown in FIG. 3, the threaded component 110 of the invention could be made of an elastic material. An adjustment knob 108 at the base of the handle could be used to stretch and extend the length of the elastic threaded section. By stretching and extending the elastic threaded section one can adjust and set the pitch of the threaded component 110, so that the amount of rotational energy derived from one motion of the linear slider 104 could be varied for different tasks. In any embodiment, the cross section of the extendable drive 103 and any collars or couplings 109 to engage the tool could be any shape that would permit free motion of the pieces sliding one within another, yet the extendable drive components engage each other rotationally so that when one rotates the rotational energy is transmitted to the other extendable drive components.

Solar Energy Power Capabilities

Some configurations of the invention may also include a component to harness solar energy. In one possible embodiment, the exterior of the extension pole could be fitted with solar cells which could transmit power to a power source, such as a battery pack. Power harnessed from the solar cells could be used to recharge the power component of the extension pole during non-use or provide longer battery power life during use. Another possible embodiment is a holding stand for the extension pole when not in use, which is fit with an outer surface which can reflect and concentrate solar energy. In one possible configuration, the stand has a holding feature to keep the pole in place, an outer surface that reflects and concentrates solar energy onto the solar cells of the extension pole. In addition, some embodiments of the solar charging features would include a charging diode to prevent over-charging of the battery or batteries.

Figure 32:
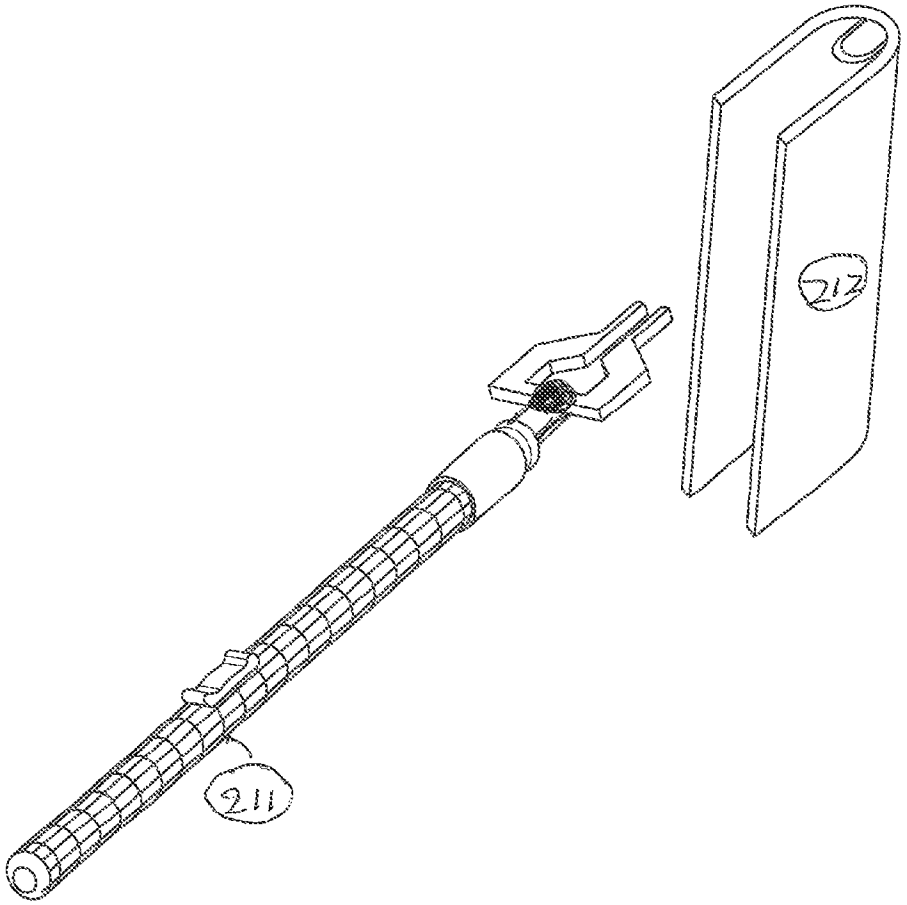
FIG. 32 Extension pole handle with photovoltaic cells.

FIG. 32 shows an extension pole handle 211 that is surfaced with photovoltaic cells. These cells convert light and radiant energy to electrical energy. The electricity produced is used to charge/recharge one or more batteries that are housed inside the handle 211. An optional solar reflective tool stand 212 has light and radiant energy reflective fins that can concentrate additional light and radiant energy onto the photovoltaic cells of the handle when the handle is placed in the stand 212 and the stand is oriented to the sun or other source of light or radiant energy.

Tool Attachment

Figure 4:
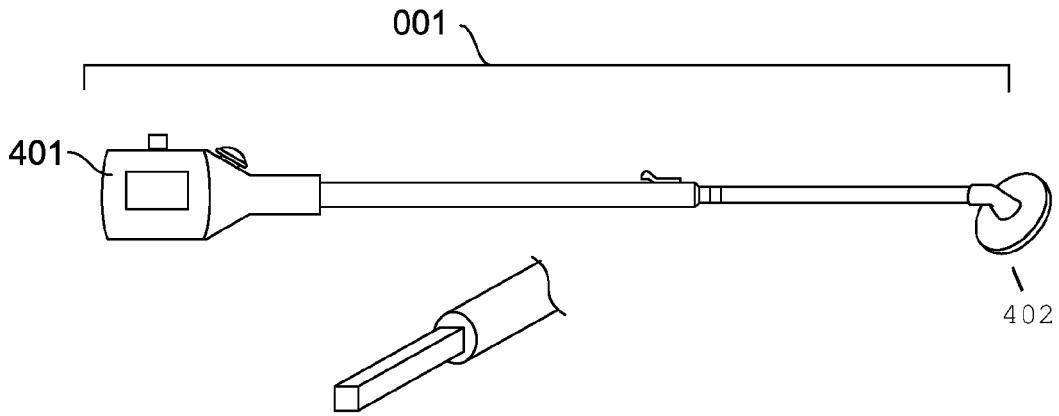
FIG. 4. External view of extension pole with power sander, motor, and extending drive mechanism.
Figure 5:
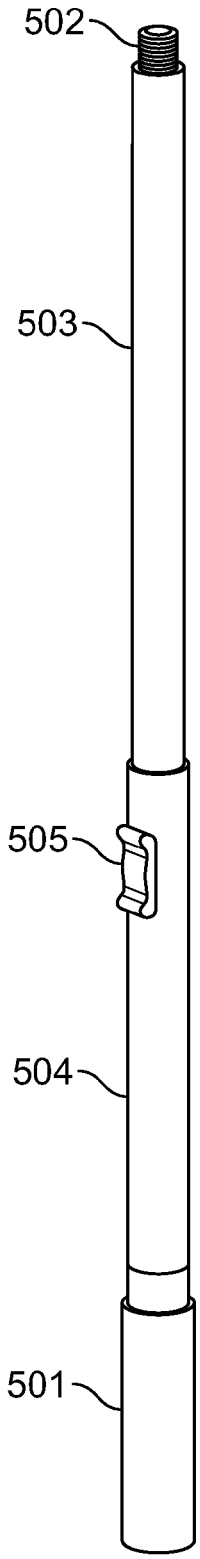
FIG. 5. Extension pole with threaded screw attachment at distal end.
Figure 6:
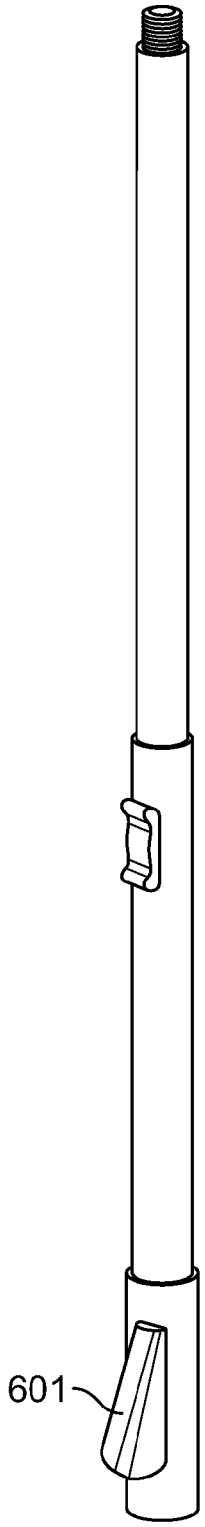
FIG. 6. Extension pole with squeeze grip actuator at handle end.
Figure 9:
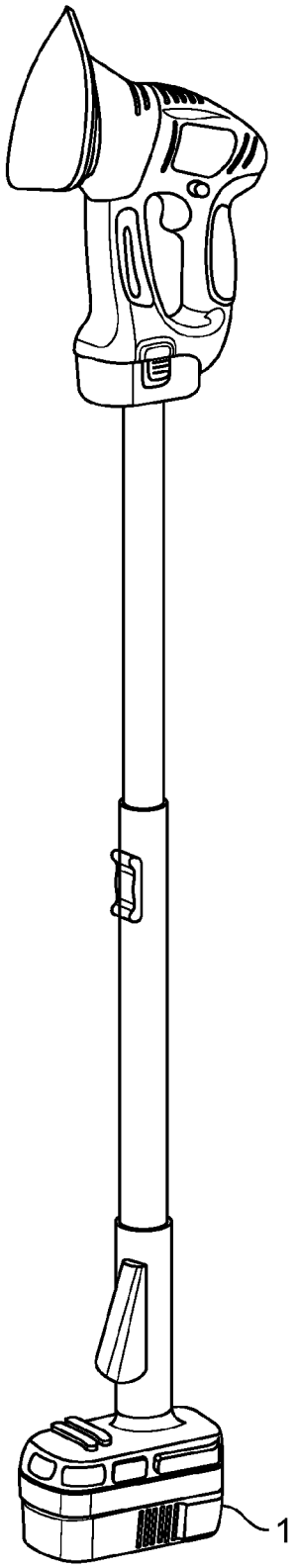
FIG. 9. A possible configuration for a power sander powered with a battery pack.
Figure 10:
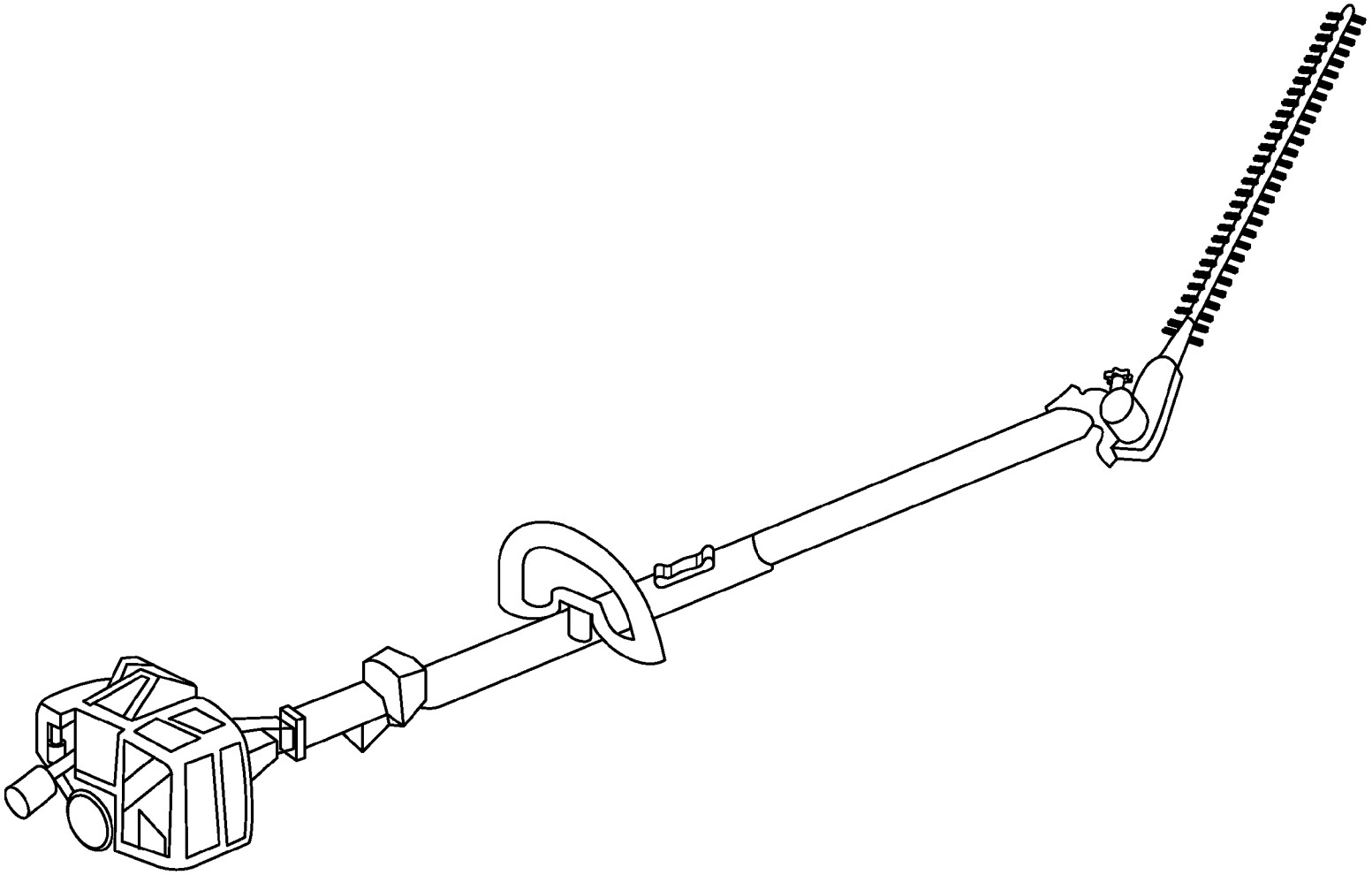
FIG. 10. A possible configuration for a powered hedge trimmer with an attached engine.

The extension power pole can be manufactured and/or used with one tool permanently attached. But in preferred embodiments, the extension pole's coupling mount is adapted to a modular design that allows for multiple tools to be attached to the pole. FIG. 4 shows a dedicated use embodiment in which the extension pole is intended for use only with a power sanding tool 402. In such cases, the tool is either manufactured onto the end of the extension pole with no option for removal, or the tool and tool-end of the extension pole can have an exclusive coupling that allows removal of the tool, but does not allow attachment of other tools. In other embodiments, the tool coupling 502 at the tool-end of the extension pole could be a universal mating feature which allows a plurality of tools of different design and/or functions (manufactured or altered to have reciprocating mating features) to be modularly attached to the tool-end of the device. A wide variety of tools may be attached, including sanders, drills, trimmers, saws, vacuums, caulking guns, paint brushes and rollers, grab tools, shears, pruners, and nozzles for water or other liquids, as illustrated in FIGS. 9 and 10.

Tool Positioning Functionality

Figure 11:
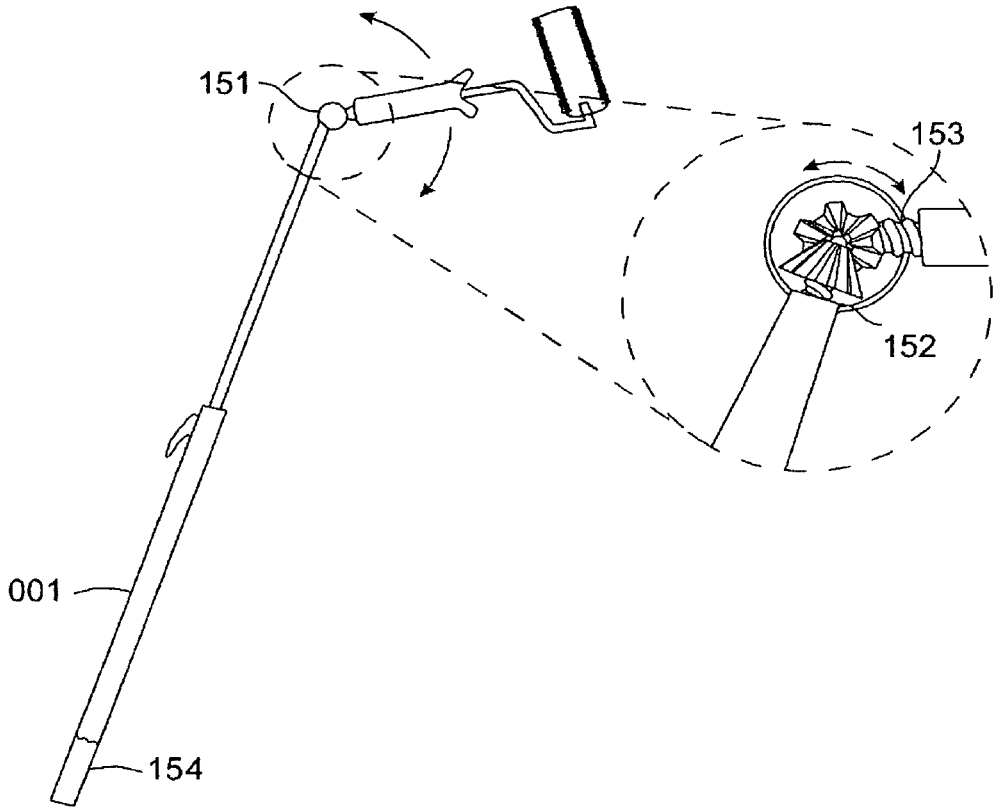
FIG. 11. Example of a possible swivel-and-lock mechanism to adjust position of tools.

In some embodiments of the invention, the coupling mount at the tool-end of the device is adapted to allow oriented at specific positions offset from the plane of the extension pole for ease of use during operation. One possible design is shown in FIG. 11. A "swivel" or pivoting mechanism 151 engages with the tool-end of the extension pole 152 and the base of the tool itself 153 and allows for movement of the tool off the axis of the pole. A swivel lock allows the swivel mechanism to be locked into one orientation once it has been properly positioned. The swivel mechanism could be inherent on the extension pole or could be a modular adapter that attaches to the extension pole 001 via mating features on the tool coupling 502 when positioning capabilities are desired.

In additional embodiments, the tool swiveling mechanism could be manually controlled or could be powered from the user-end of the pole. One possible embodiment of the swivel mechanism, as depicted in FIG. 11, involves a swivel mechanism 151 controlled from the user-end handle of the device. A spring-loaded "notched" handle 154 allows for the mechanism to lock into one of multiple discrete handle positions, which correlate to multiple increasing or decreasing angles of the swivel mechanism. The handle 154 can be pulled toward the user against the spring force, rotated, and moved from one "notch" to another "notch". As the handle 154 is pulled and rotated to different notched positions, a rotating extendable power transmission or similar system adjusts the position of the swivel mechanism 151 at the tool-end of the device. When the handle 154 is released by the user, an internal spring exerting compressive tension forces the handle taut against the extension pole 001 in its specific notched position, effectively locking the handle 154 and swivel mechanism 151 in place at a specific angle. An additional possible mechanism for locking the mechanism is the use of a threaded collar that connects the rotating handle to the pole. This threaded collar can be loosened to allow the handle to rotate in relation to the pole and then tightened to lock the rotating handle and the connected swivel to a certain position, correlating to a specific degree of tilt in the swivel mechanism.

Figure 12:
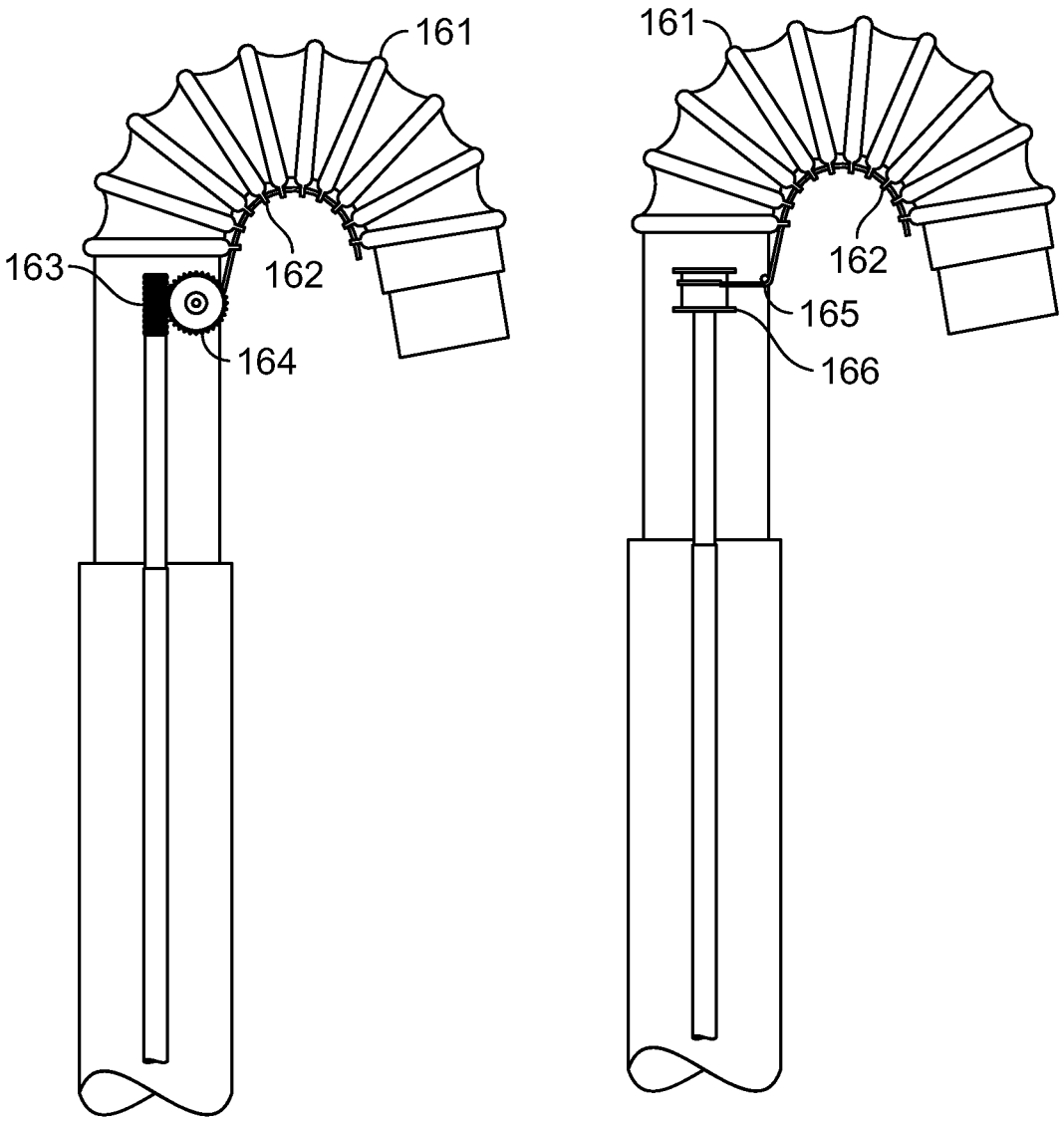
FIG. 12. Example of a possible articulation mechanism at the tool-end of the invention.
Figure 13:
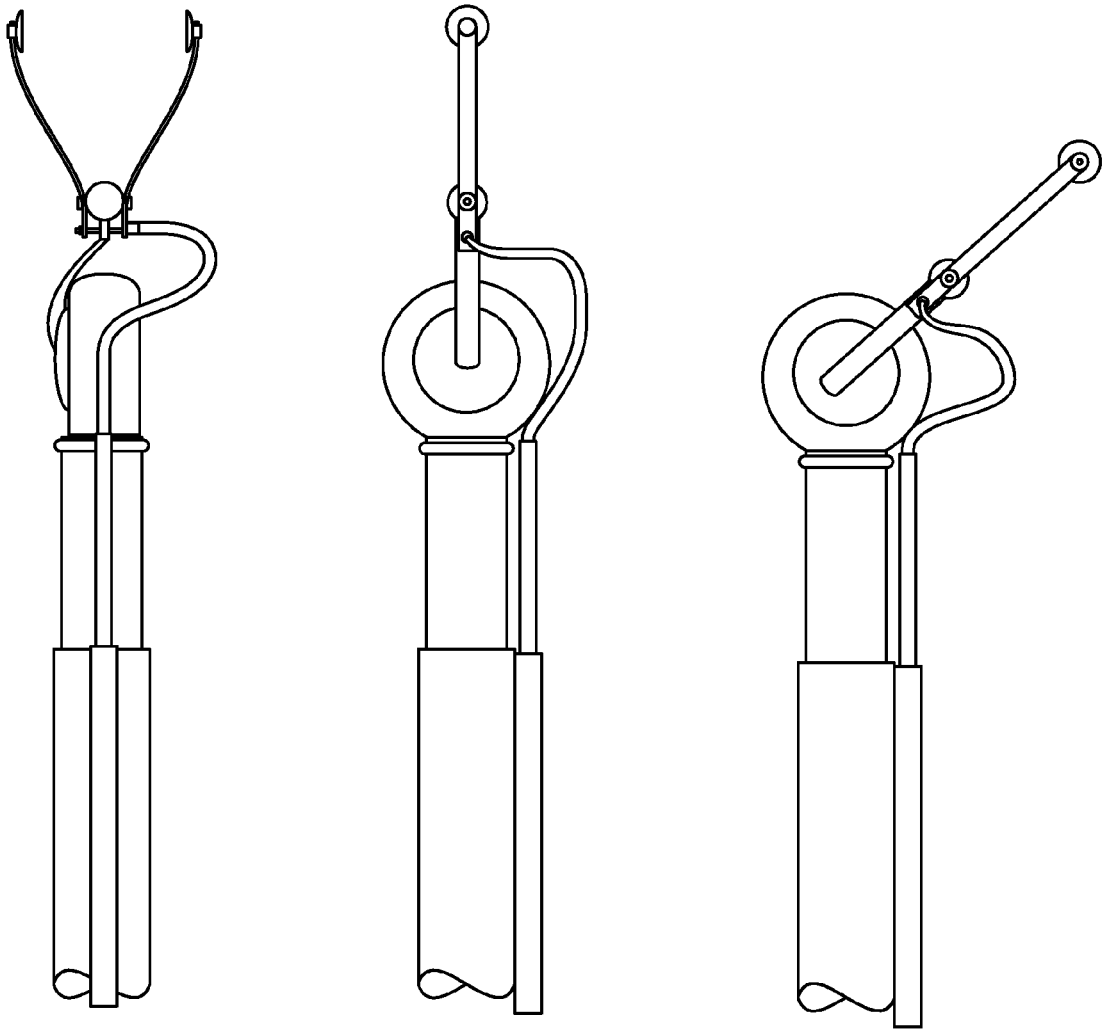
FIG. 13. Front and side views of extension pole grabber tool.
Figure 16:
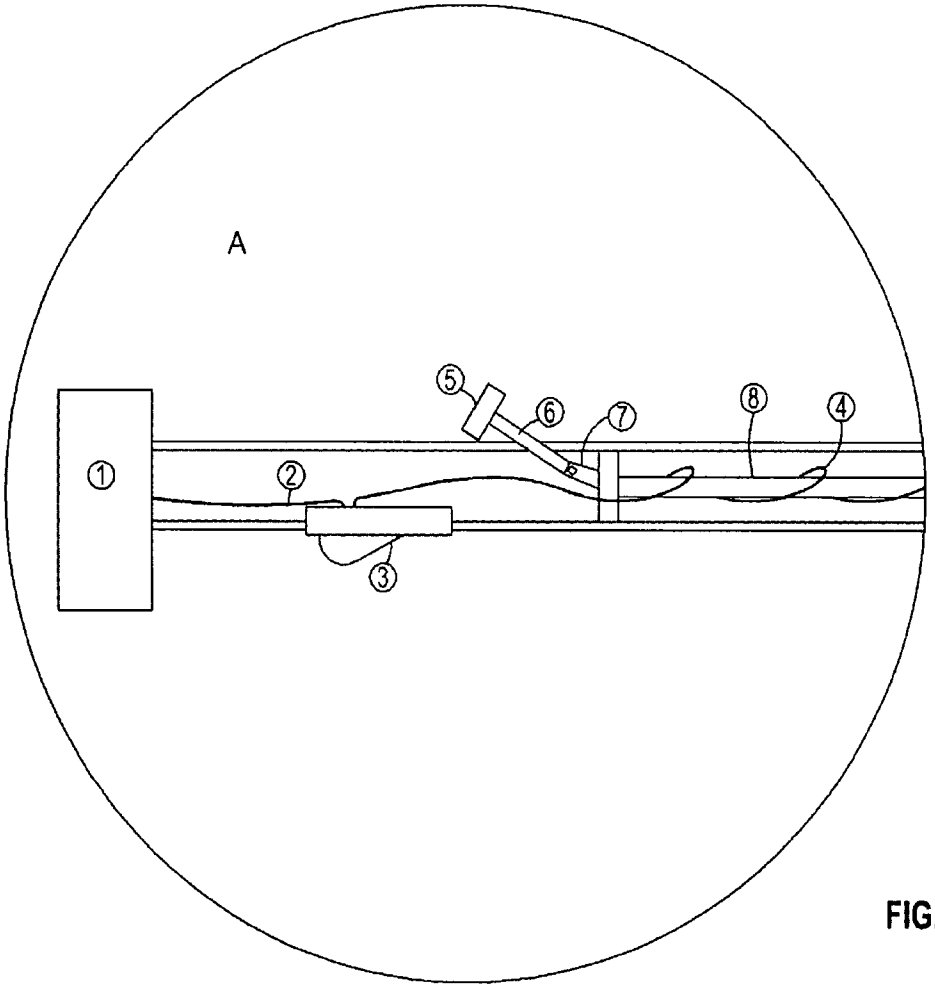
FIG. 16. Cutaway view of battery pack and user-end.
Figure 17:
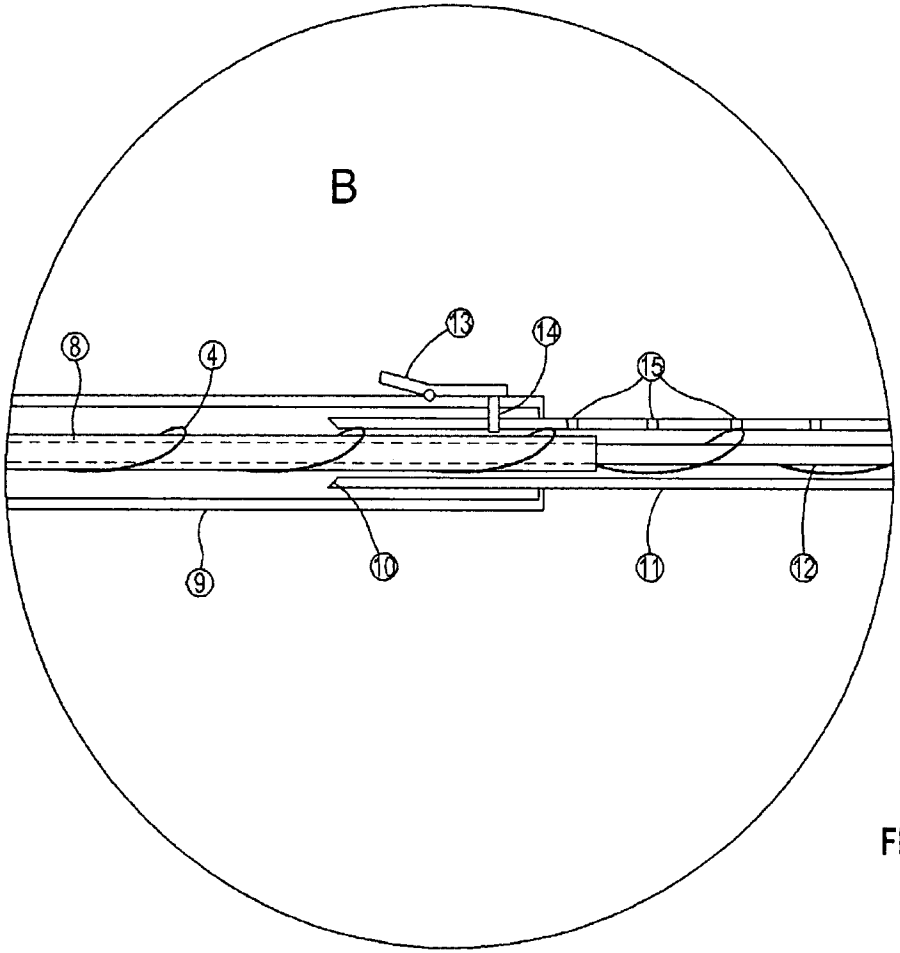
FIG. 17. Cutaway view of the telescoping and locking components.

In other embodiments, the device may utilize articulation of the tool-end to improve maneuverability. One possible configuration for articulation is illustrated in FIG. 12. In this design, a flexible tube tool 161, which could be used in a number of functions such as spraying or vacuuming, is connected to a flexible rod, wire or cable 162 along the outer edge of the tool. The cable is connected to a power transmission such as a rack 163 and gear set 164 or a pawl 165 and spool 166. In both configurations, the power mechanism pulls or pushes the cable 162, causing a change in the orientation of the attached flexible tube 161. Although only one cable is shown in FIG. 16, the articulating mechanism could include opposed cables to allow pulling to each side of the flexible tube tool 161.

Additional Extension Pole Features

The extension pole can be attached to a near endless number of different tools. Some such tools perform functions include sanding, drilling, trimming, sawing, vacuuming, caulking, painting, grabbing, shearing, pruning, and washing, as illustrated in FIGS. 4, and 9 through 21. In addition, there can be multiple different power mechanisms and combinations of power mechanisms.

FIG. 13A shows a manually powered grabber tool variant of the invention. The grabber is actuated by a cable 171 attached to a threaded component moved linearly by the rotational energy provided by the transmission mechanism. When the transmission mechanism moves the threads back towards the user, the cable 171 is pulled taut at the action 178, pulling apart the grabber arms 174. The grabber arms 174 and fulcrum joint 179 are constructed so that, when the cable is relaxed, compressive force closes the grabber, creating the grabbing action. Alternatively, in embodiments where default tension at the fulcrum joint 179 spreads the grabber arms 174, the action 178 may be moved above the fulcrum joint 179, so that tension on the cable 171 pulls the grabber arms 174 closed. It is possible to incorporate multiple transmissions, either inside and/or outside the tube. As shown in FIG. 13B-C, additional articulating functionality may be provided using a cable attached to the external drive mechanism which pulls the grabber arms 174 to an angled position when the drive mechanism is pulled back.

Figure 14:
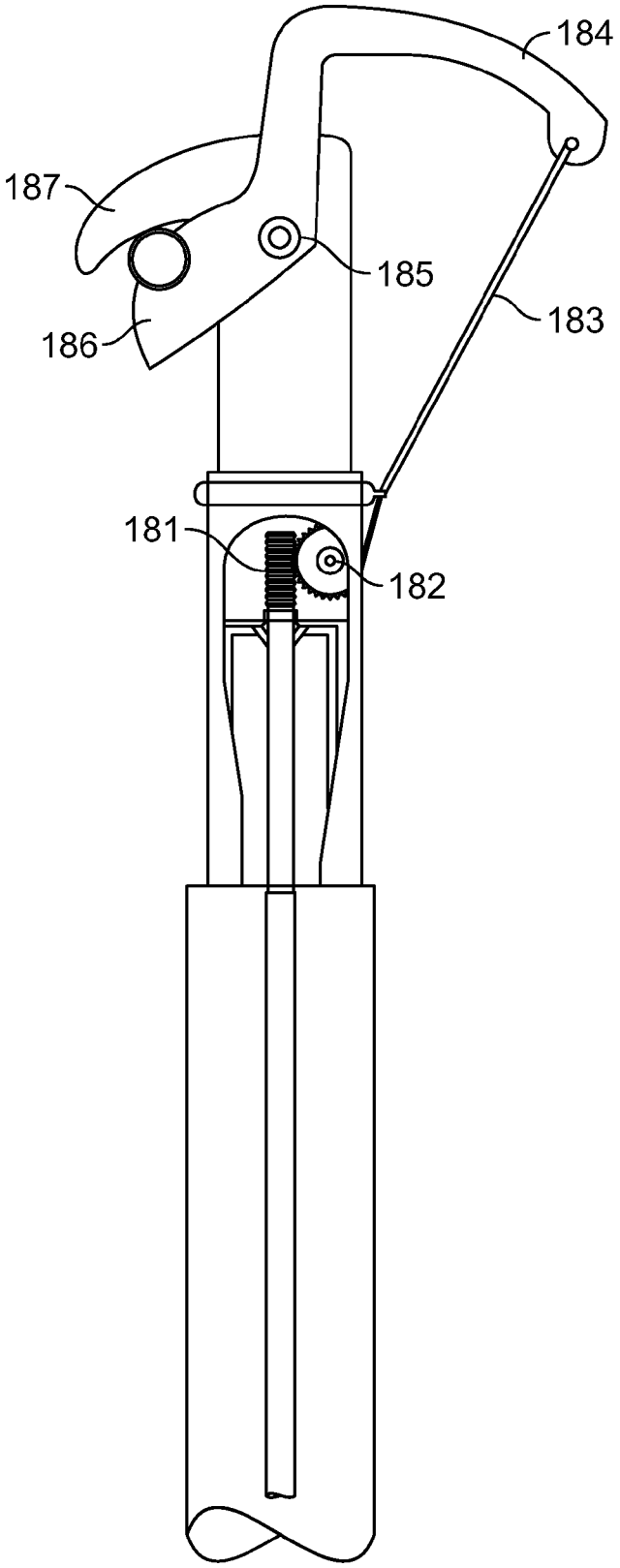
FIG. 14. View of extension pole cutting tool with rack and gear power transmission.
Figure 15:
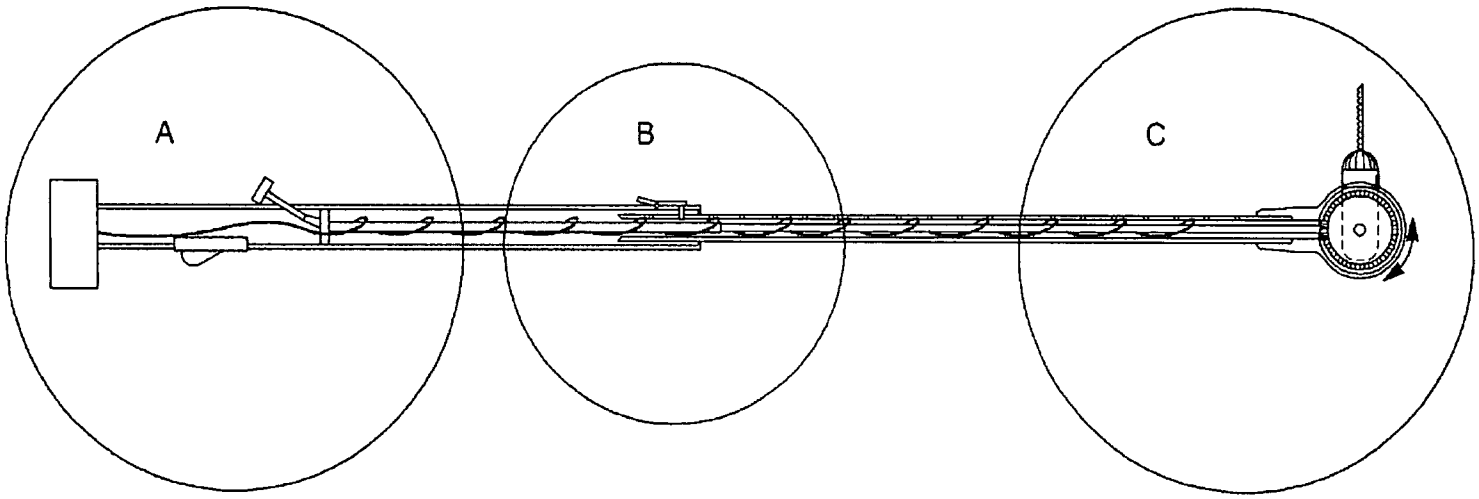
FIG. 15. Battery powered extension pole with adapter piece.

FIG. 14 shows a rack-and-gear embodiment of the invention utilized to manipulate cutting tools or shears at the end of the extension pole. The movement of the rack 181 drives the gear 182 to pull back a transmission member 183 such as a flexible rod, wire or cable. The transmission member 183 connects to a lever arm 184 on the shears, which causes rotation about a pivot 185 and pulls the bottom jaw 186 of the shears to the top jaw 187 to complete a cutting motion. Such a rack-and-gear set is preferably housed inside the hollow tubes of the extension pole with an outlet for the transmission member 183, although it could be external to the extension pole. The power supply for the movement of the rack 181, not pictured in the illustration, could be any of those described previously.

An additional possible design is shown in FIGS. 15-18. A battery pack 1 is attached to the power extension pole 001. It could be permanently affixed or be removably attached. Power from the battery pack is relayed to a switch or trigger 3 via an internal power cord 2. The slack in the power cord could be regulated or adjusted via coils or loops that take up excess cord length in the extendable electrical power transmission cord or wire 4. The switch or trigger 3 can be a variable speed trigger or switch, additionally an additional switch can be provided that changes the polarity to the power transmitted through the coiled power cord 4. This change of polarity can be used to reverse the direction of motors or change the functions of tools at the tool end. In addition to the electrical power relayed via one or more batteries, an additional manual power transmission mechanism could be present in the device. In one embodiment, an external handle or knob 5 is attached to an internal extension drive mechanism 6, and universal joint 7 which transmits the manual rotational input at the knob 5 from the user to an extendable rotational transmission 8.

This embodiment of the extension power pole could be comprised of two hollow tubes 9 and which telescope freely one inside the other. The proximal end 10 of the inner telescoping tube 11 could be slanted such that the internal power cord 4 would not be caught or pulled when the pole is extended and retracted. To lock the telescoping tubes in place to prevent unwanted sliding, a series of slots 15 are present on the inner telescoping tube wall and a corresponding peg feature 14 is present on the outer telescoping tube. The peg 14 is controlled by a toggle mechanism 13 on the outer tube that biases the peg into the inner tube slot 15 and locks the two tubes together, preventing any unwanted sliding. A button at one end of the toggle 13 is depressed, the toggle pivots and the peg 14 is removed from one of the holes 15, thus unlocking the telescopic poles allowing the assembly to be extended or retracted as desired.

The internal rotational energy drive transmission assembly comprising the telescopic drive parts 8 and 12 extends through the length of the extension pole and extends and retracts in tandem with extending and contracting the outer telescopic tubes 9 and 11. The end of the extension pole could, in some configurations, be a modular system designed to hold different tools.

Figure 18:
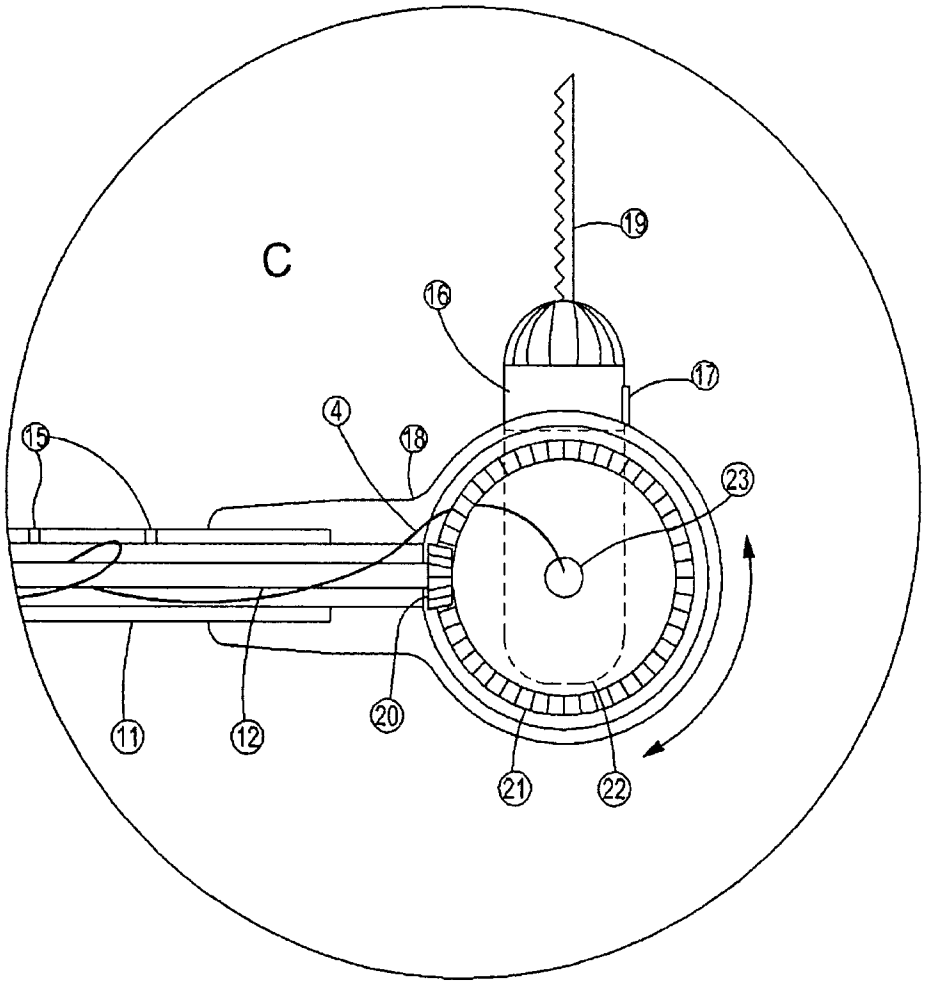
FIG. 18. Cutaway view of detail of tool-end and coupling element.

The embodiment illustrated by FIG. 18 shows a modular tool head assembly comprising an articulating swivel head tool assembly comprising a gear set 20 and 21 and an electric motor 22 and housing assembly 18. When the knob 5 of FIG. 16 is manually rotated, the rotational energy is transmitted through the universal joint 7, to the telescopic energy transmission tubes and/or rods 8 and 12 to the gear 20. The gear 20 engages with the gear 21 and when the gear 20 is rotated the gear 21 is also rotated. The gear 21 is attached to a motor and housing 22 to which a modular tool assembly 16 is removably attached. This assembly comprising the gear 21, the motor and housing 22 and the removably attached modular tool 16 is attached to a housing frame or shell 18 via a pivot point 23. The housing frame 18 is affixed to the extension pole inner tube 11. The motor inside the motor housing 22 is powered by electricity conveyed through the coiled cord 4 and is controlled by the operator via the trigger switch of 3 in detail FIG. 16. (N.B. The motor is not directly connected to the first and second gear in a manner designed to convey force to or from the internal rotational energy drive transmission. The rotational transmission merely allows articulation of the motor's orientation relative to axis 23; the electric motor provides power to whatever tool is attached to it.). The modular tool 16 is removably attached to the motor housing through a mating assembly and locks in place with a latch assembly 17. The motor engages and powers the removably attached modular tool assembly 16. A button on the latch assembly 17 releases the latch when depressed, allowing the modular tool to be removed and replaced with a modular tool assembly of a different design or function. Although a reciprocating saw assembly 19 is depicted, modular tools of many different designs and functions can be made to be used with the invention, including cutters, sanders, saws, drills, rotary cleaning tools, hedge trimmers, etc. This configuration allows the user to both control a power tool at the end of an extension pole and to articulate or swivel the tool as needed while in use.

Figure 31:
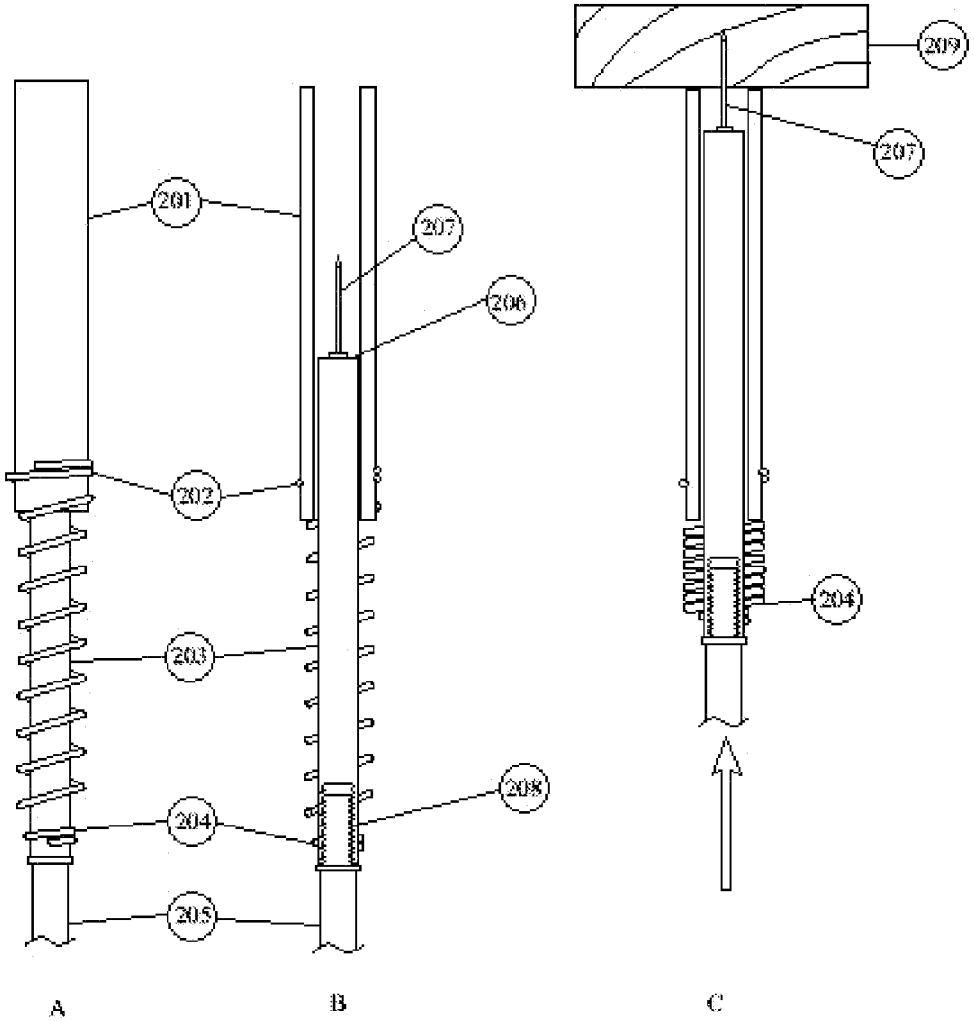
FIG. 31. Slide hammer embodiment of the invention.

FIG. 31 shows a slide hammer embodiment of the invention. A magnetized head 203 is attached to the end of a telescoping pole at a screw coupling 208. The magnetized head holds a nail 207 at the end of the hammer head 206 with the help of a guide 201. Force applied to the pole 205 is transferred to the head 203 to drive the nail into a body 209. A spring attached to the guide 201 and pole 205 at junctures 202 and 204, respectively, applies expansive force to reset the guide between strokes of the hammer.

Figure 33:
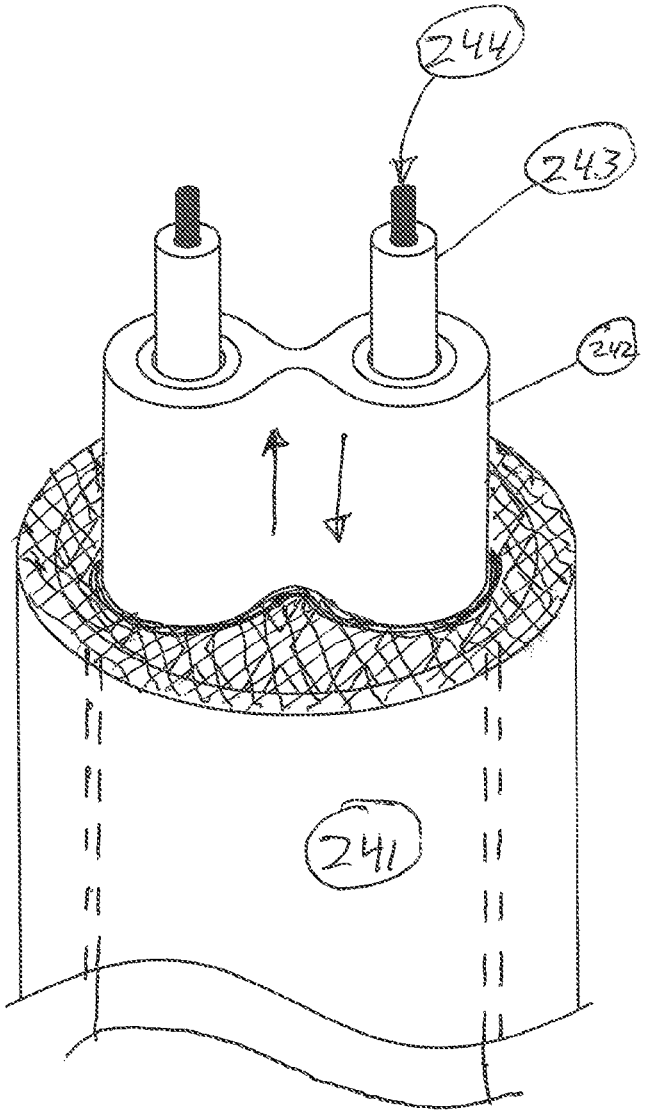
FIG. 33. View of electrically conductive elements incorporated inside a telescopic power transmission assembly.

FIG. 33 shows electrically conductive elements incorporated inside a telescopic power transmission assembly. An outer tube 241 has an interior hollow cross section that allows a shaft profile 242 to move transversely back and forth through the interior hollow of 241. However when the outer tube 241 is rotated the rotational energy is transmitted to the shaft profile 242. The shaft profile 242 can house a plurality of conductive wires 244 that can transmit electricity or electronic pulses or signals. These wires 244 can convey power and/or signals from the user end of the extension pole assembly to the opposing end, the tool end of the assembly. 243 shows a dielectric protective cover or coating that electrically insulates the wire 244. It is possible that the shaft profile be constructed of a rigid dielectric material so that the shaft profile also performs the function of the dielectric cover or electrical insulation.

Bar Clamp and Spreader Tool

Figure 19:
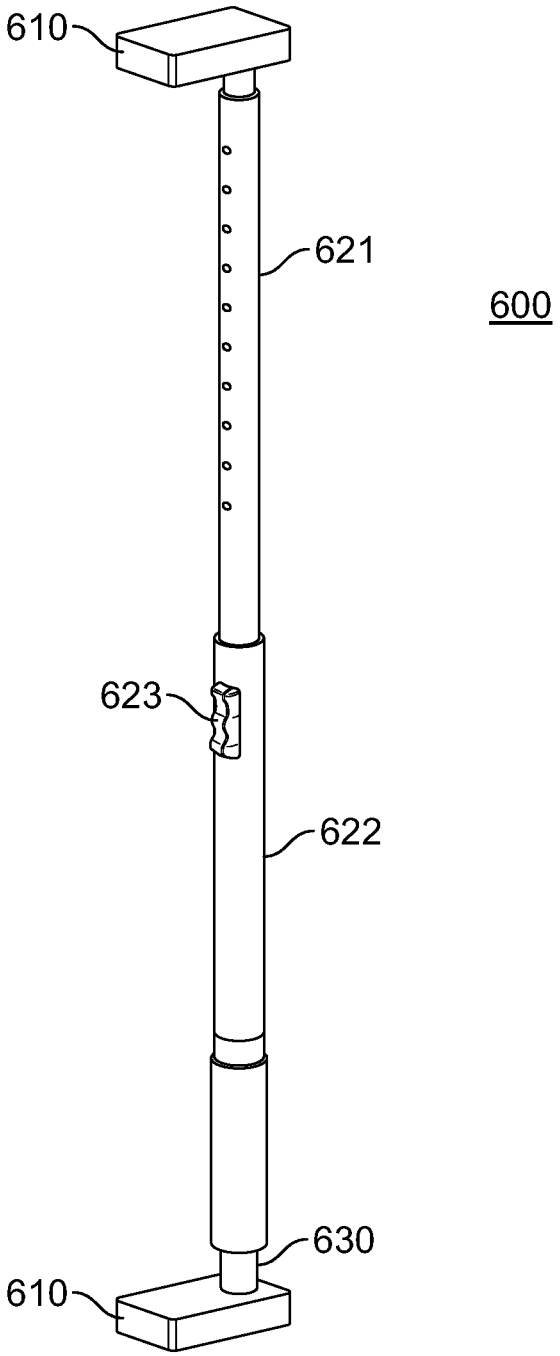
FIG. 19. External view of basic telescoping bar clamp/spreader tool

An important second variation on the telescoping tool concept is a bar clamp or spreader tool 600 utilizing a telescoping tube as its spine. FIG. 19 demonstrates the general configuration of the bar clamp/spreader tool. A telescoping tube is comprised of two long metal shafts 630. These shafts are different diameters, so that an inner shaft is received by the outer shaft. This allows them to extend and retract from one another. Enclosing the shafts are two sections of telescopic tubing 621 622. The smaller telescopic tube 621 is a smaller diameter allowing it to slide into the larger diameter telescopic tube 622. Attached to the larger diameter telescopic tube is a locking mechanism to prevent the telescopic tubing from unintentionally extending and retracting. In FIG. 19 there are two contact plates 610 attached to either end of the metal shafts.

Figure 20:
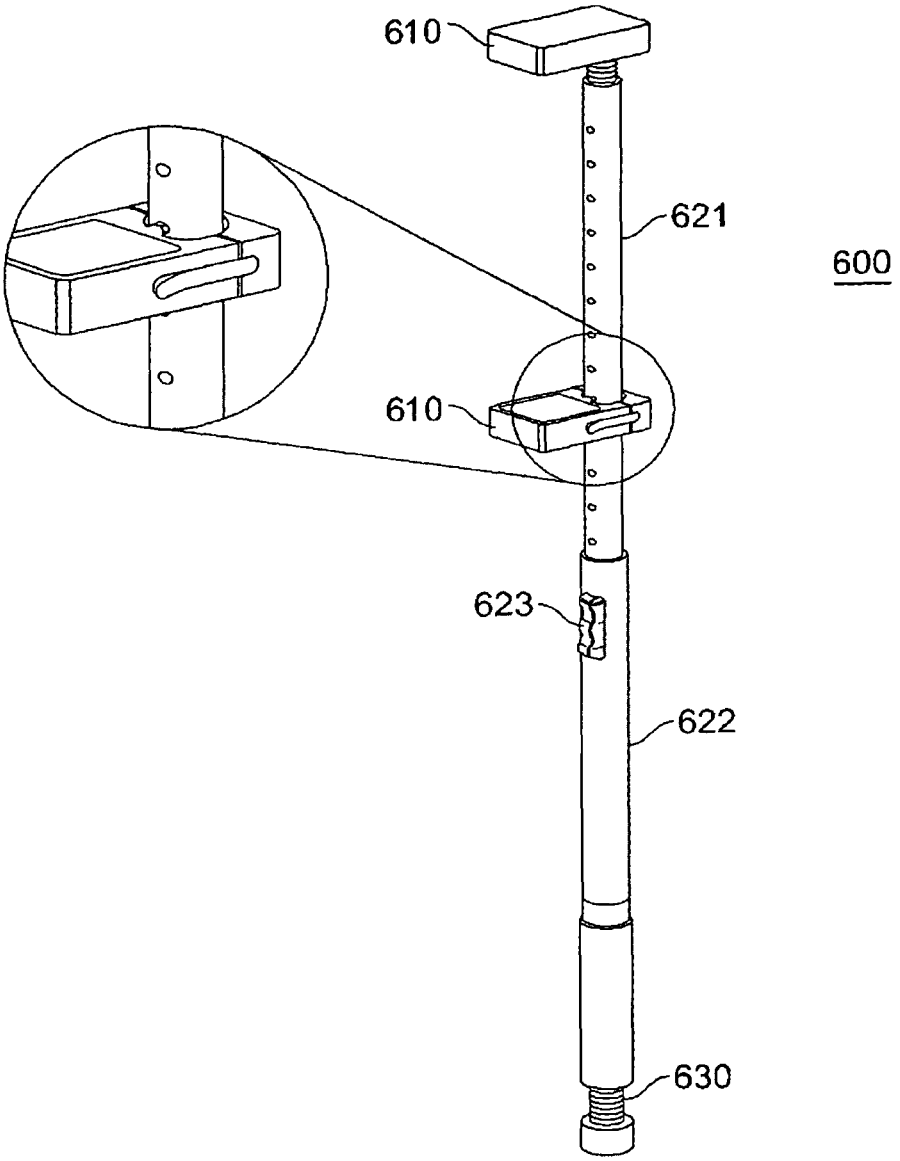
FIG. 20. External view of variant of telescoping bar clamp/spreader tool in which both jaws of the clamp/spreader are attached to one shaft of the telescoping assembly.

The embodiment shown in FIG. 19 is exemplary, not limiting. In FIG. 19, the contact plates 610 are attached to the shaft by being screwed into screw threads on the metal shaft. It is not essential that the contact plates 610 be attached directly to the shaft, nor do they need to be attached via a screw mechanism. As shown in FIG. 20, the contact plates 610 can be attached along the telescopic tubing using a clamping mechanism. The contact plates may include padding or not, and may be smooth or be manufactured with textured surfaces to improve grip.

Figure 23:
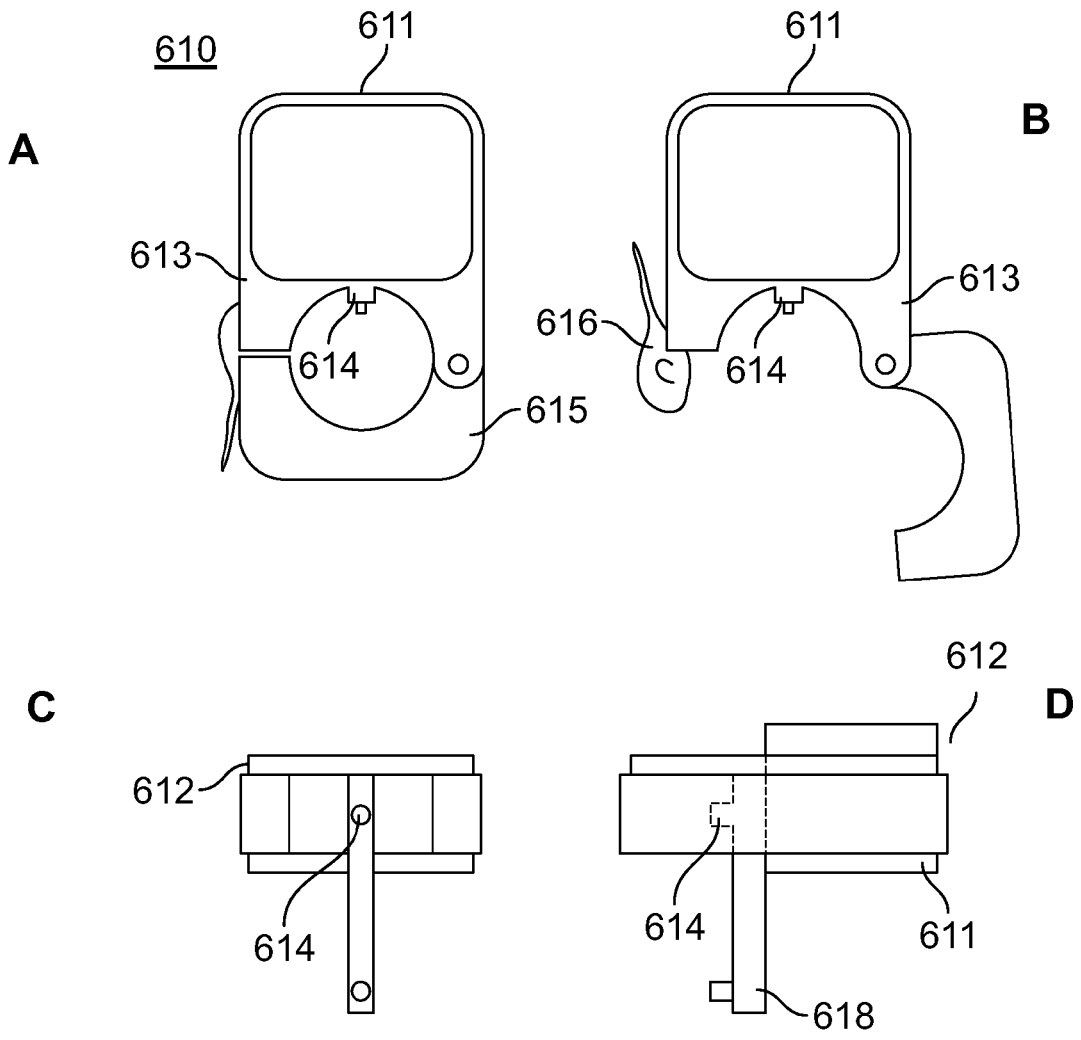
FIG. 23. Detailed views of removable pads for adjustable locking pin embodiment, showing facial views of removable pad in open and closed configuration (top left and right), and cutaway views of pad from side (bottom left) and bottom (bottom right).

In a distinct embodiment of the invention, shown in FIG. 20, an adjustable contact plate 610 is attached to the inner tube proximal to the handle from the distal contact plate 610. FIG. 23 shows a series of detailed views of a padded contact plate 610 and its clamping mechanism. FIG. 23A shows a facial view of a removable pad in the closed position. FIG. 23B shows a facial view of the pad with the hinge closed. FIG. 23C shows a cross section of the pad in the closed position viewed from the bottom, and FIG. 23D shows a cross-section of the pad from the side. In this embodiment, the contact plate 610 is comprised of bottom padding 611, top padding 612, a body 613, at least one locking tooth 614, a hinged jaw 615, and a hinge lock 616. The padding may be made of a high friction material such as rubber. The contact plate may be attached to the telescopic tube using locking jaw, with the locking teeth fitting into complementary holes placed at regular intervals on the telescope tube. To attach the pad to the telescopic tubing one would begin with the pads in the open position as shown in the upper right of FIG. 23. The pad would be positioned up against the telescopic tubing so that the cylindrical protrusions are mechanically engaged with the holes of the telescopic tubing. Next, the hinged closing section of the pad will swing closed and the lock will be mechanically linked to the hinged closing section. The lock to the hinge door can be accomplished through a variety of locking or latch mechanisms that will be apparent to one of skill in the art.

Squeeze Grip Extension Mechanism

Figure 21:
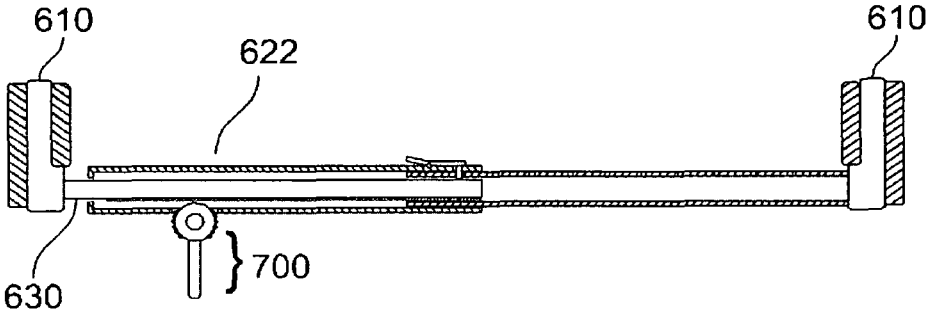
FIG. 21. External view of telescoping clamp/spreader tool with squeeze grip locking mechanism.

FIG. 21 shows two embodiments of the bar clamp/spreader tool with a squeeze grip mechanism, each placing the squeeze grip at a different location. In this mechanism, an inner shaft 630 is contained within a larger diameter telescopic tube 622. The metal shaft 630 can be either solid or hollow. Attached to the larger diameter telescopic tube is a lever 700 which will be a locking mechanism for the retraction and extension of the metal spreader vise.

Figure 22A:
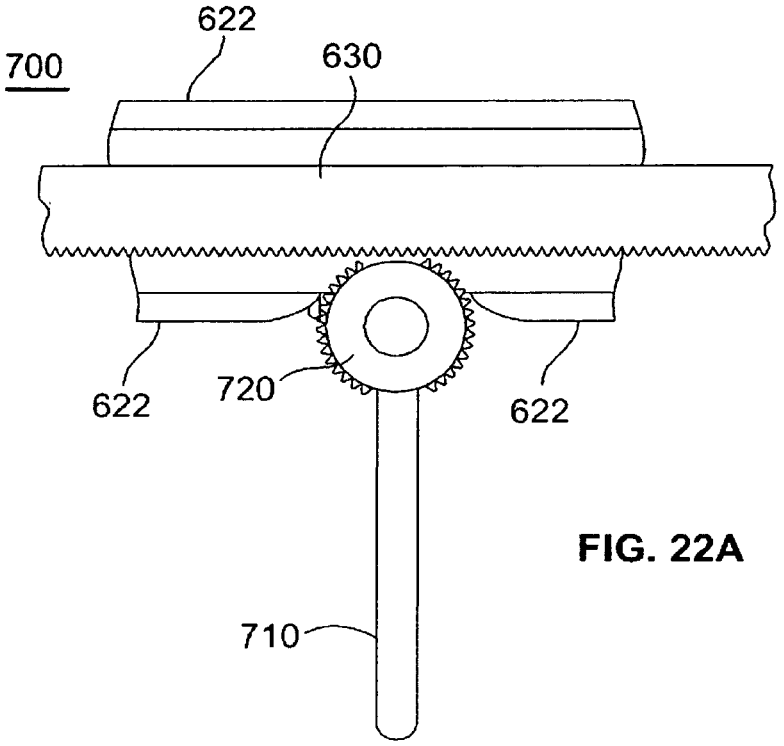
FIG. 22. Detailed view of squeeze grip locking mechanism.
Figure 22B:
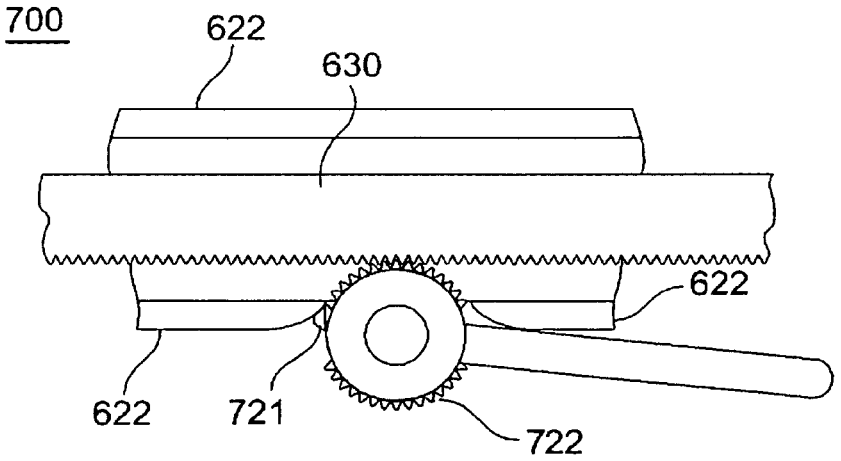

FIG. 22 shows two close up views of the squeeze grip mechanism in two different locked configurations. The lever 700 comprises a lever arm 710 and a pivot hinge 720. Along the outer surface of the coupling of the lever arm to the axis of the pivot hinge, there is a section containing gear teeth 722 and a section lacking gear teeth 721. When this device is in the locking position, the gear teeth along the pivot hinge are engaged with gear teeth running along the metal shaft 630. In this position, the spreader vise cannot extend or retract. To change the device to the open position, the lever arm is rotated so that the toothless portion 721 of the pivot hinge is facing the metal shaft. In this position, the gear teeth of the pivot hinge and metal shaft are no longer linked. This allows the spreader vise to extend and retract freely. To lock the spreader vise at the desired length one rotates the lever back to the locking position.

There are other possible embodiments of the squeeze grip extension mechanism. In one alternate embodiment the squeeze grip will be used to rotate a thumb screw. When the thumb screw is tightened the metal shafts will be unable to extend. When the thumb screw is loosened, the metal shafts will be free to extend or retract. Another alternate embodiment could involve the use of a slider catch to lock the extension and retraction of the spreader vise.

Many variations of the invention are possible. For example, the telescoping tube could include a drive mechanism to expand and contract the telescoping tube.

Rotational Extension Mechanism

In a turnbuckle-like embodiment of the invention, the tube assembly comprises a set of two internal shafts and a set of two external tubes, with, two clamp/spreader jaws, one jaw attached to each end of the tube assembly. The internal shafts are capable of telescoping, but each is rotationally fixed in relation to its partner shaft. The same is true of the external tubes in relation to each other. The distal ends of the internal shaft are threaded, and the external tube assembly comprises two threaded caps, one threaded cap fitted within each tube assembly in a fixed manner relative to the external tube assembly. Rotational force applied to the external tube assembly is converted by the threaded caps to longitudinal force on the internal shafts, such that the two clamp/spreader jaws widen or narrow when the external tube assembly is rotated.

Figure 24:
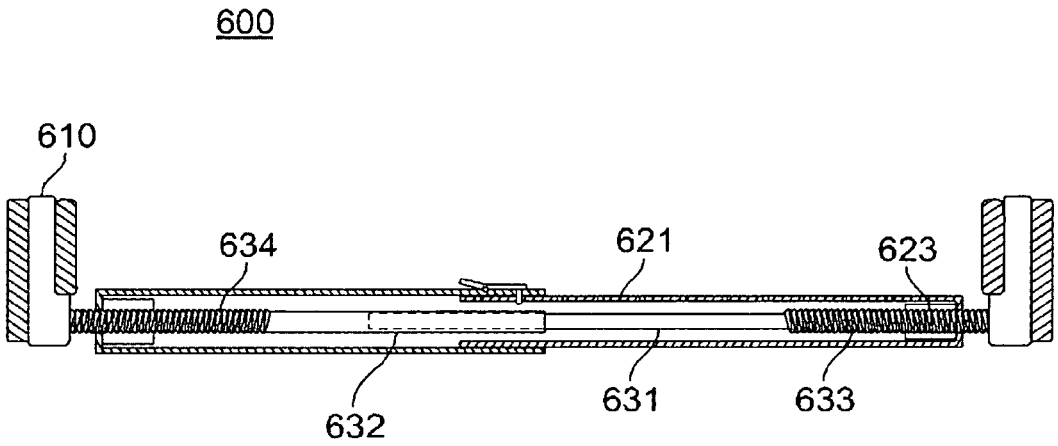
FIG. 24. Cutaway view of Turnbuckle Rotational Extension/Retraction Embodiment FIG. 25. External view of adjustable bar clamp jaws linked onto both ends of extension pole.

FIG. 24 shows one example of the turnbuckle-type embodiment of the telescoping bar clamp and spreader tool. The telescoping tube encompasses two metal shafts 630. On the outer ends of each metal shaft 630 there are oppositely threaded screw threads 634 and 633. Each metal shaft 630 also has an inner portion 631 and 632 which lacks screw thread. The shafts 630 are of different diameters allowing one to slide into the other. The non-threaded portion 631, and the complementary receiving volume of 632, are a non-circular shape such that the inner shaft and outer shaft cannot rotate independently of one another. The shape of the non-threaded portions 631 and 632 of the metal shafts can be any shape which would impede rotation such as a square, oval, or pentagon. The outer threaded portions (633 and 644) of the metal shafts 630 allows each shaft to join to the outer 621 and inner 622 telescopic tubing, respectively, as well as the contact plates 610. The threaded portions of the metal shafts are round. The shafts are joined to the telescopic tubing through threaded sockets 623 in the telescopic tubing. The operation of the rotational extension mechanism operates as a turnbuckle. One of the contact plates 610 can be stabilized rotationally by pushing it up against a contact surface. Then, as the telescopic tubing is rotated, it expands or contract, depending on the direction of rotation. This causes extension or retraction of the contact plates, depending on the direction of rotation.

Quick Action Clamps

Figure 25:
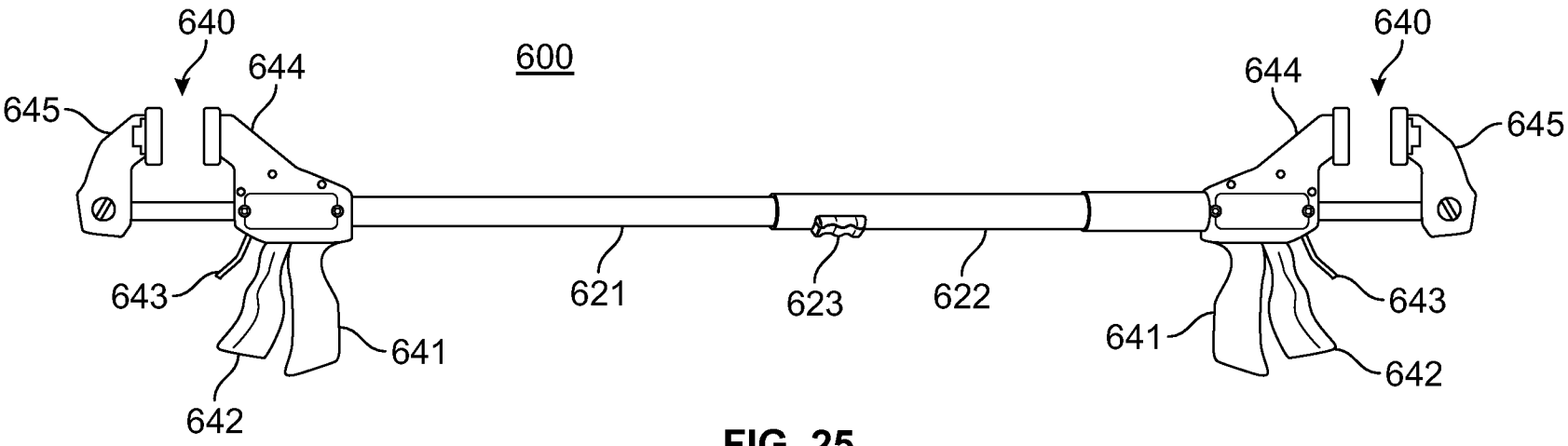
Figure 26:
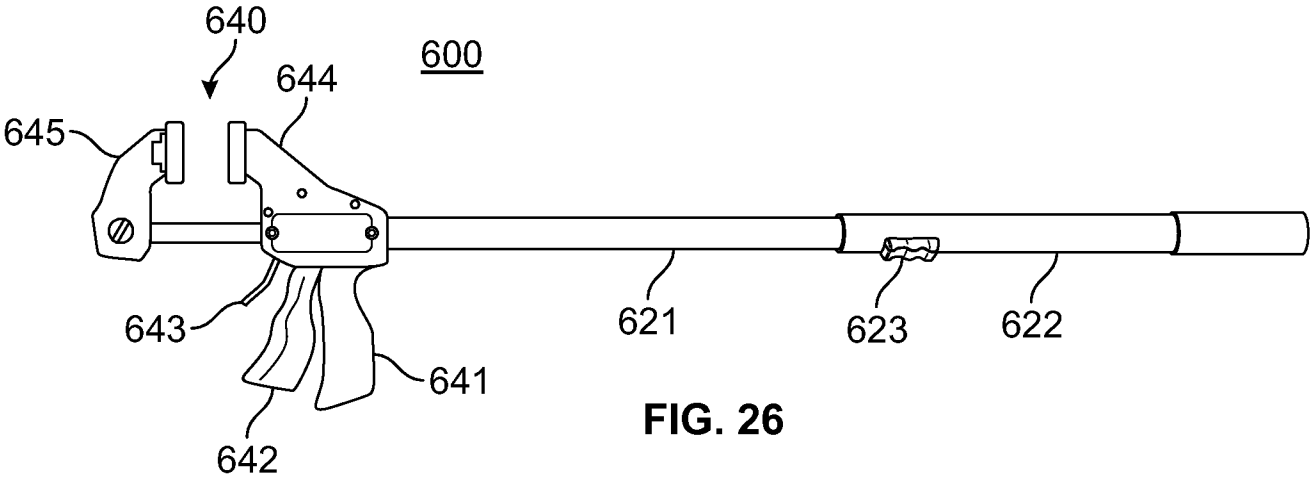
FIG. 26. External view of single bar clamp attached to power transmitting extension pole FIG. 27. External view of extendable clamping device attached to rotational power transmitting extension pole.

Another type of clamping attachment for the bar clamp/spreader tool is attachment of subsidiary bar clamps 640. These clamps, shown in FIGS. 25 and 26, are based on quick action clamps known in the art. The operation of the clamps is controlled by three handles: the stationary handle 641, the clamping handle 642, and the releasing handle 643. To clamp an object, the object would be placed between the upper jaw 645 and the lower jaw 644. The clamping handle is then repeatedly squeezed towards the stationary handle and released. Each time the clamping handle 642 is squeezed, the upper jaw will migrate towards the lower jaw. This is continued until the desired object is adequately stabilized between the jaws. To release the clamp, the release handle is pressed towards the clamping handle. As long as the release handle is pressed the upper jaw is free to slide into an unclamped position. It is possible to have other variations of the bar clamp where the lower jaw migrates toward the upper jaw when the clamping handle is squeezed. Additionally the spreader vise may only have one spreader vise attached as in FIG. 26.

Figure 27:
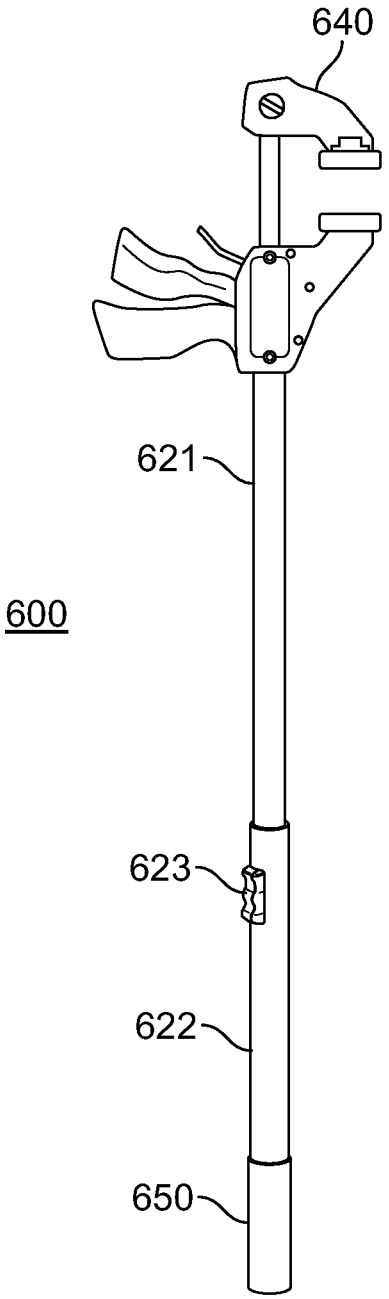

The clamping mechanism of the spreader vise does not need to rely on pressing handles. FIG. 27 depicts an embodiment of the device where the clamping is accomplished through rotating the bottom handle 650 of the spreader vise. In this embodiment, rotating the bottom handle one way will close the jaws of the spreader clamp. Rotating the handle the opposite direction will open the jaws of the spreader clamp. It is also possible for this mechanism to be accomplished electrically.

In yet another embodiment, each of the first and second shafts of the telescoping tube assembly has its own set of adjustable jaws, arranged so that each tube may be clamped to an object, and the distance between the objects may be controlled by adjusting the telescoping tube. In another embodiment, the telescoping tube has notches arranged in regular, equidistant intervals, and the clamp/spreader jaws are comprised of removable plates with one or more locking pins that fit into the notches.

Three Dimensional Frame

Figure 28:
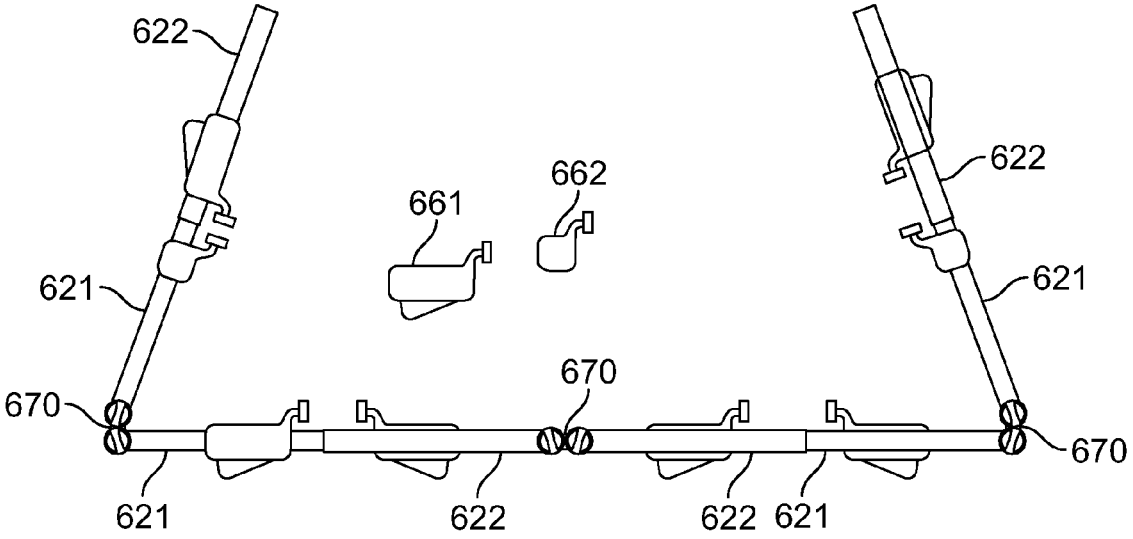
FIG. 28. View of multi-tube embodiments with removable clamp/spreader jaws.
Figure 29:
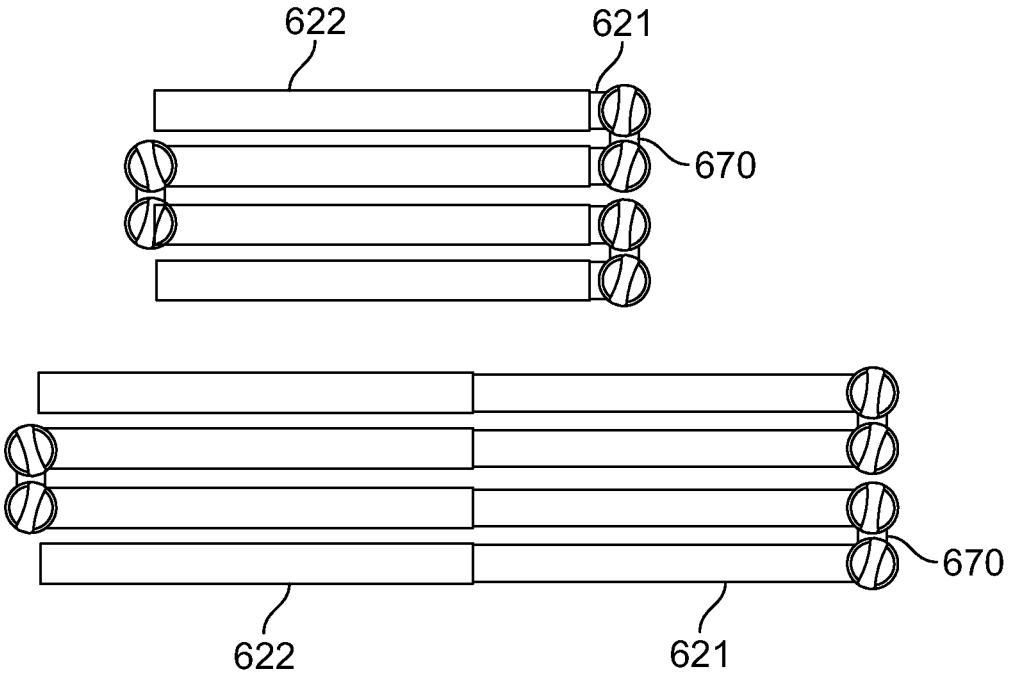
FIG. 29. View of multi-tube frame in folded position, with tubes collapsed and expanded, respectively.

By attaching multiple telescoping tubes end-to-end with connecting joints, the device can be configured into a three dimensional frame as seen in FIGS. 28 and 29. In this example, the frame is composed of four spreader vises attached using three locking hinges 670. The locking hinge attaches to two spreader vises at their end and allows them to rotate about a pivot. This pivot can become rigid by turning a dial located on the pivot. Because of these locking hinges the frame is able to assume a three dimensional open configuration as seen in FIG. 28. The frame can also be collapsed into an easy to store closed configuration as shown in FIG. 29. In this embodiment of the device, the spreader clamps used are slightly different than those used in previous embodiments. Instead of using one spreader clamp 640, the embodiment shown in FIG. 28 uses a stationary jaw 662 and a clamping jaw 661. The stationary jaw is clamped onto the telescopic tubing of a spreader vise and cannot move after being clamped. The clamping jaw can be clamped onto the device and moved by pumping the handle on the jaw. This is similar to the clamping mechanism discussed for the spreader clamp 640. Both the stationary and clamping jaws are one sided to allow them to clamp onto the telescopic tubing.

Figure 30:
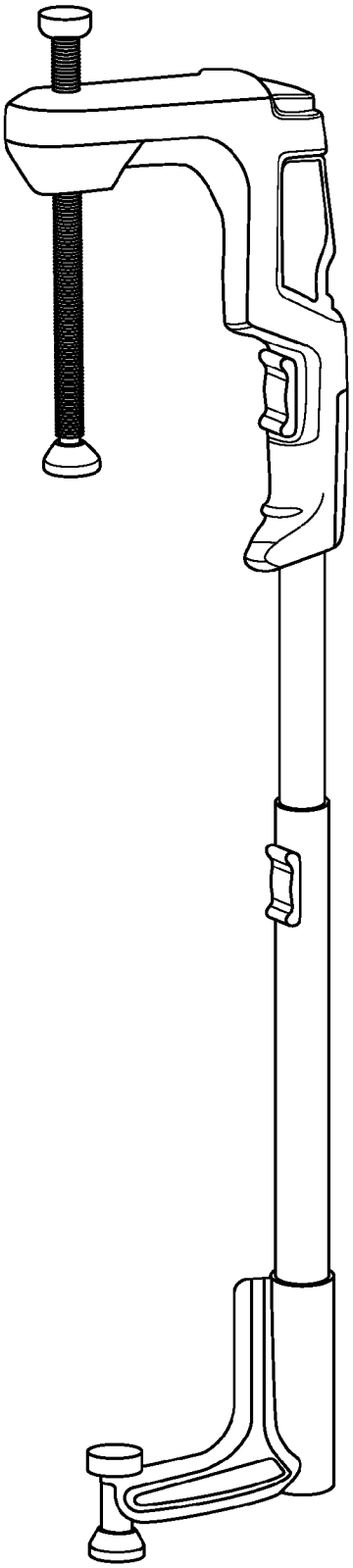
FIG. 30. View of bar clamp using telescoping tube as spine.

FIG. 30 shows an embodiment with permanently attached clamps at each end of a telescopic tube. The telescopic tube can be used to perform gross adjustments of the clamp, while fine adjustments can be made using a standard screw clamp assembly attached to one end.

The invention claimed is:

1. An apparatus comprising:

a telescoping pole assembly comprised of an inner tube and outer tube, said inner tube and outer tube being substantially identical length, said telescoping pole assembly having a collapsed configuration wherein at least two thirds of the inner tube length is received within the outer tube and an extended configuration wherein at least ⅔ of the inner tube is external to the outer tube;

an extension lock, said extension lock attached at a receiving end of said outer tube having an open position and a locked position, said extension lock allowing, when in the open position, the inner tube to translate along its shared axis with the outer tube in a variable manner and holding, when in the locked position, the inner tube in a fixed position of extension along the common axis of the telescoping pole assembly relative to the outer tube, wherein said extension lock may engage its locked position in at least the collapsed configuration and the extended configuration of the telescoping pole assembly;

an extendable rotational mechanical transmission contained within the telescoping pole assembly, said extendable rotational mechanical transmission comprising a second outer tube and an inner rod, the inner rod translatable along its shared axis with the second outer tube and rotationally engaging the second outer tube on the second outer tube's inner surface, a user-end control interface attached to a first end of the telescoping pole assembly, said user-end control interface comprising a rotating handle connected the extendable rotational transmission to transmit rotational energy from the user to the extendable rotational transmission, an articulable tool-end coupling permanently attached to a second end of the telescoping pole assembly, said coupling allowing removable attachment of one or more tools or pivot mechanisms to the tool-end of the telescoping pole assembly.

2. The apparatus of claim 1, wherein the articulable tool-end coupling comprises a bevel gear pivot assembly attached to the tool-end coupling, comprising one or more gears coupled to the extendable rotational transmission and one or more additional bevel gears enmeshed with the first bevel gear and connected to a pivot assembly that is rotatable about an articulation axis.

3. The apparatus of claim 2, wherein the articulable mechanism and bevel gear assembly are encased inside a protective housing.

4. The apparatus of claim 3, further comprising a motor within said second housing, said motor coupled to said bevel gear assembly.

5. The apparatus of claim 4, further comprising an electrical circuit from said motor through said articulable tool coupling into said telescopic pole assembly.

6. The apparatus of claim 5, wherein the electrical circuit connects to a trigger switch at the user-end, said trigger switch controlling the flow of electricity through the circuit.

7. The apparatus of claim 6, further comprising a second housing encompassing said second gear, said second housing fixedly attached to said second gear and rotatable in relation to said first housing and further comprising a modular tool coupling and an attachment lock for said modular tool coupling.

8. An apparatus comprising:

a telescoping pole having an first pole section and second pole section, said second pole section being received within said first pole section to a variable extension;

an extension lock on the receiving end of said first pole section, said extension lock having an open position and a locked position, wherein said extension lock may engage its locked position at any extension of the telescoping pole between fully collapsed and fully extended to hold the extension at a fixed length;

a user-end control interface attached to a first end of the telescoping pole, an articulable tool-end coupling permanently attached to a second end of the telescoping pole and allowing removable attachment of one or more tools, operably linked to said user-end control interface, and an extendable rotational mechanical transmission contained within the telescoping pole, said extendable rotational mechanical transmission comprising an outer tube and an inner rod, the inner rod translatable along its shared axis with the outer tube and rotationally engaging the outer tube on the outer tube's inner surface, wherein said user-end control interface comprising a rotating handle connected to the extendable rotational transmission to transmit rotational energy from the user to the extendable rotational transmission.

9. The apparatus of claim 8, wherein the extendable transmission comprises a first drive shaft interior to the first pole section and a second drive shaft interior to the second pole section, the first and second drive shaft being coupled to each other at a drive shaft coupling to translate rotational motion from the first drive shaft to the second drive shaft.

10. The apparatus of claim 9, wherein the first drive shaft comprises an exterior spiral groove on its surface that extends from the end opposite the user-end interface toward the user-end interface, and wherein the telescoping pole further comprises a movable slider fitted to the outer surface of the first pole section, said movable slider comprising an outer slide movably fitted to the first pole section and an inner slide fixedly attached to the outer slider and situated within the first pole section, said inner slider extending into said exterior spiral groove to contact the surface of said exterior spiral groove.

11. The apparatus of claim 10, wherein the first drive shaft is comprised of an elastic material, and the user-end interface further comprises an adjustable handle attached to said first drive shaft.

12. The apparatus of claim 10, wherein the extension lock comprises a mechanism selected from the group consisting threaded collet, spring-loaded toggle clips, positioning holes with spring-loaded buttons, locking pins, concentric over-center actuation pins, collar locks, and slider catches.

13. The apparatus of claim 9, further comprising a first gear attached to the tool-end coupling of said telescoping pole.

14. The apparatus of claim 13, further comprising an articulable tool coupling connecting to said first gear, said articulable tool coupling having and a first housing contacting said second end of the telescoping pole, said first housing encompassing a second gear, said second gear in contact with said first gear and rotatable about an articulation axis connecting said second gear to said first housing.

15. The apparatus of claim 14, further comprising a second housing encompassing said second gear, said second housing fixedly attached to said second gear and rotatable in relation to said first housing and further comprising a modular tool coupling and an attachment lock for said modular tool coupling.

16. The apparatus of claim 15, further comprising a motor within the second housing and an electrical circuit connecting said motor with said user-end control interface.

17. The apparatus of claim 16, wherein said modular tool coupling comprises part of the second housing and is attached to said motor.

* * * * *